US005145759A

United States Patent [19]

Terrell et al.

[11] Patent Number: 5,145,759

[45] Date of Patent: Sep. 8, 1992

[54] ELECTROPHOTOGRAPHIC RECORDING MATERIAL

[75] Inventors: David R. Terrell, Lint; Stefaan K. De Meutter, Zandhoven; Marcel J. Monbaliu, Mortsel, all of Belgium

[73] Assignee: AGFA-Gevaert, N.V., Mortsel, Belgium

[21] Appl. No.: 509,248

[22] Filed: Apr. 16, 1990

[30] Foreign Application Priority Data

Apr. 21, 1989 [BE] Belgium ..... 89201035.6

[51] Int. Cl.[5] ..... G03G 5/047; G03G 5/09

[52] U.S. Cl. ..... 430/58; 430/59; 430/83; 430/95; 430/900; 430/74; 430/78; 430/79

[58] Field of Search ..... 430/74, 78, 79, 83, 430/95, 900, 58, 59

[56] References Cited

U.S. PATENT DOCUMENTS 3,798,031 3/1974 Janssens et al. ..... 430/78 X
3,912,509 10/1975 Janssens et al. ..... 430/79
4,264,695 4/1981 Kozima et al. ..... 430/83 X
4,755,443 7/1988 Suzuki et al. ..... 430/78 X
4,882,253 11/1989 Kato et al. ..... 430/59
4,923,774 5/1990 Van der Auweraer et al. ..... 430/59

*Primary Examiner*—Roland Martin
*Attorney, Agent, or Firm*—Breiner & Breiner

[57] ABSTRACT

An electrophotographic recording material comprising on an electrically conductive support a negatively chargeable photoconductive recording layer which contains in an electrically insulating organic polymer binder material at least one photoconductive n-type pigment substance and at least one p-type photoconductive charge transport substance as defined herein by a general formula (I) to (V), wherein said layer has a thickness in the range of 4 to 40 μm and comprises 8 to 80% by weight of said n-type pigment substance and 0.01 to 40% by weight of said p-type charge transport substance that is molecularly distributed in said electrically insulating organic polymeric binder material that has a voluem resistivity of at least $10^{14}$ Ohm-m, and wherein said recording layer in electrostatically charged state requires for 10% and 90% discharge respectively exposures to conductivity increasing electromagnetic radiation that differ by a factor 4.5 or less.

17 Claims, 21 Drawing Sheets

ELECTROPHOTOGRAPHIC RECORDING MATERIAL

DESCRIPTION

Figure 1:
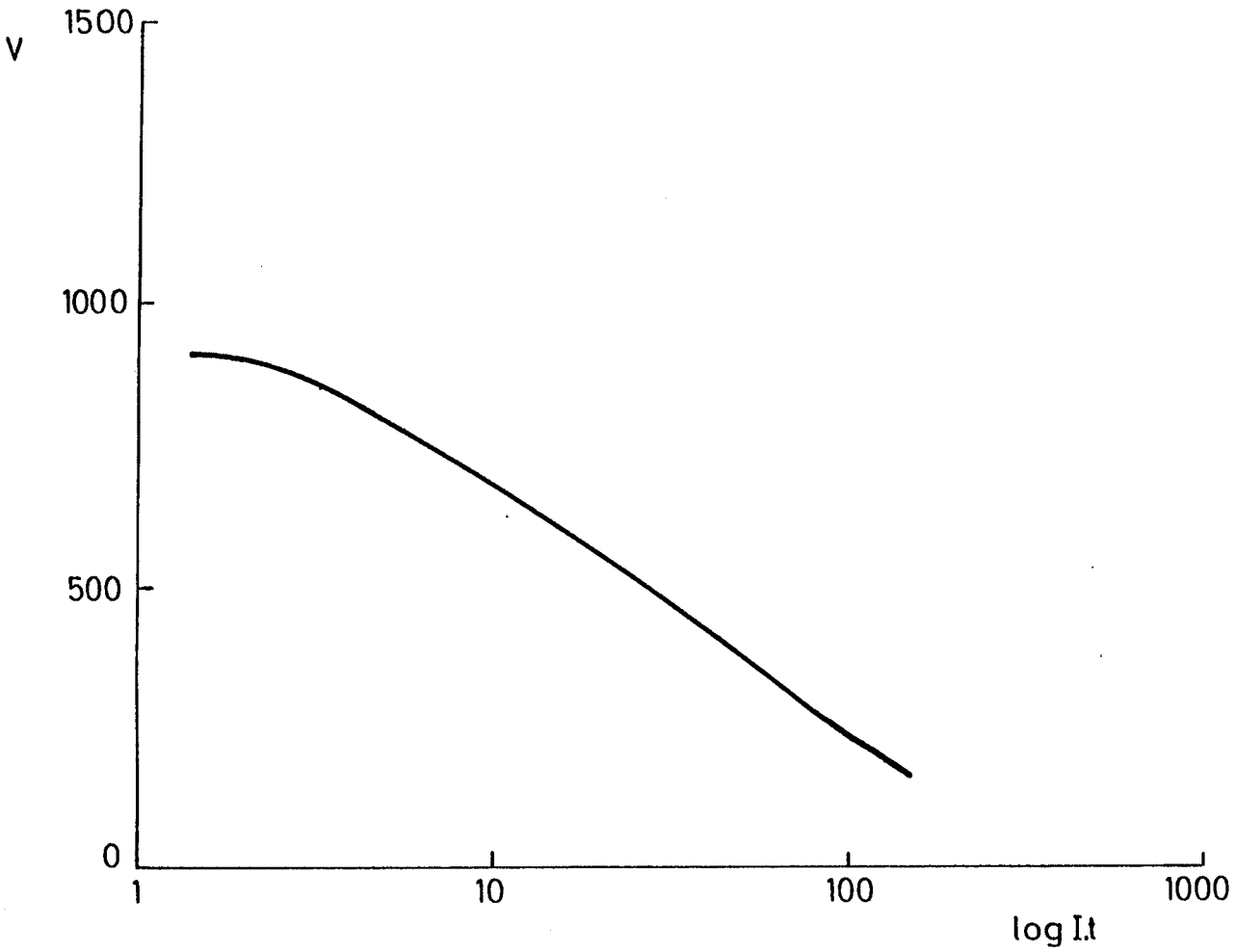
Figure 2:
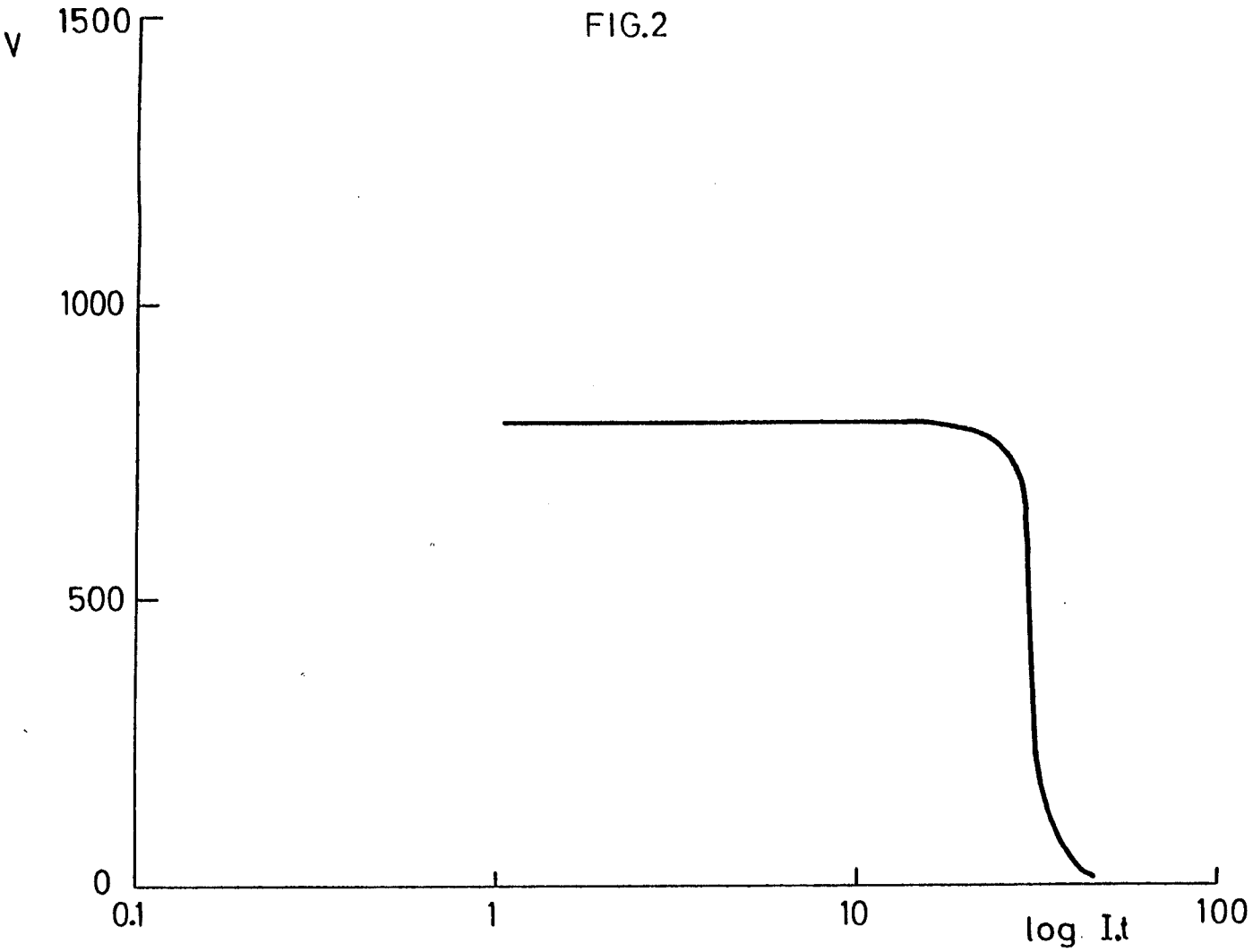

The present invention relates to a photosensitive recording material suitable for use in electrophotography.

In electrophotography photoconductive materials are used to form a latent electrostatic charge image that is developable with finely divided colouring material, called toner.

The developed image can then be permanently affixed to the photoconductive recording material, e.g. photoconductive zinc oxide-binder layer, or transferred from the photoconductor layer, e.g. selenium layer, onto a receptor material, e.g. plain paper and fixed thereon. In electrophotographic copying and printing systems with toner transfer to a receptor material the photoconductive recording material is reusable. In order to permit a rapid multiple printing or copying a photoconductor layer has to be used that rapidly losses its charge on photo-exposure and also rapidly regains its insulating state after the exposure to receive again a sufficiently high electrostatic charge for a next image formation. The failure of a material to return completely to its relatively insulating state prior to succeeding charging/imaging steps is commonly known in the art as "fatigue".

The fatigue phenomenon has been used as a guide in the selection of commercially useful photoconductive materials, since the fatigue of the photoconductive layer limits the copying rates achievable.

Another important property which determines whether a particular photosensitive recording material is suitable for electrophotographic systems is its discharge-exposure relationship. Conventional recording materials on the basis of an electrostatically charged photoconductive layer exhibit a fairly gradual increase in discharge as a function of increasing exposure to photoconductivity increasing electromagnetic radiation. The radiation dose, also called exposure, required for 10% and 90% discharge differs normally by factors of about 10 to 40 depending on the choice of photoconductive recording material.

Electrophotographic copying systems wherein such photoconductive recording materials are used in the reproduction of halftone image originals, i.e. images composed of equi-dense screen dots in which density variation is obtained only by varying dot frequency or by varying dot size and dot frequency, yield images of degraded quality (resolution) when compared with images obtained on lith-type silver halide emulsion materials.

Electrophotographic printing systems operating with scanning light sources such as analog-signal or digital-signal modulated laser beams or light emitting diodes with such photoconductive recording materials likewise produce degraded prints due to the enhancement of background and the blurring of the dots as a result of each dot having a halo caused by the unsharp edge of the writing beam.

It is therefore desirable for high quality electrophotographic copying and printing to have a photoconductive recording material with a sharp decrease in charge expressed in voltage (V) (as a result of sharp increase in conductivity) within a narrow range of photo-exposure dose (E) [E=photon-intensity (I)×time (t)]. More explicity it is desirable in order to avoid said image quality degradation to work with a photoconductive recording material with which the exposures required for 10% and 90% discharge differ by a factor of only 4.5 or less.

Another important property which determines whether or not a particular photoconductive material is suited for electrophotographic copying is its photosensitivity that must be high enough for use in copying apparatus operating with fairly low intensity light reflected from the original.

Commercial usefulness further requires that the photoconductive layer has a chromatic sensitivity that matches the wavelength(s) of the light of the light source, e.g. a laser or has panchromatic sensitivity when white light is used e.g. to allow the reproduction of all colours in balance.

Intensive efforts have been made to satisfy said requirements, e.g. the spectral sensitivity of selenium has been extended to the longer wavelengths of the visible spectrum by making alloys of selenium, tellurium and arsenic. In fact selenium-based photoconductors remained for a long time the only really useful photoconductors although many organic photoconductors were discovered.

The first generation of organic photoconductors consisted of single layers in which a polymeric charge transport material such as poly(N-vinylcarbazole) (PVK) or charge transport molecules such as the 1,2-dihydro-2,2,4-trimethylquinoline derivatives described in U.S. Pat. Nos. 3,830,647 and 3,832,171 dissolved in an inert polymeric binder such as a polycarbonate were sensitized with dissolved dyes or dispersed pigment particles. Examples of the latter are the so-called "photoemission active material" (PEAM) layers such as those disclosed by Regensburger and Jakubowski in U.S. Pat. No. 3,877,935 for novel xerographic plates containing photoinjecting polynuclear quinone pigments including 4,10-dibromoanthanthrone in concentrations of 0.1 to 5 percent by volume with 5 to 99 percent by volume of photoconductor material. Hackett also described such layers in 1971 in the Journal of Chemical Physics, Volume 55, page 3178 consisting of 25 wt % X-phthalocyanine dispersed in poly(N-vinylcarbazole).

With 5 to 10 um thick PEAM-layers consisting of about 40% by weight of the p-type charge transport material 2,4-bis(4-N,N-diethylaminophenyl)oxadiazole, 0.5 to 10% by weight of N,N'-dimethylperylimide in a binder [ref. Chemiker Zeitung 106, 313 (1982)] Wiedemann observed photosensitivities expressed as half-value voltage drop exposures ($I_o.t_{\frac{1}{2}}$) of 50 to 100 mJ/m2 for positive and negative charging.

Nakazawa, Muto and Tsutsumi in 1988 [Japan Hardcopy Proceedings May 16–18, 1988] described a positively chargeable 18 um PEAM-layer with metal-free phthalocyanine and N,N'-bis(3,5-xylyl)perylimide as the sensitizing pigments and a charge carrier transport material, which exhibited optimal photosensitivity ($I_o.t_{\frac{1}{2}}$) of 238 mJ/m2 at a metal-free phthalocyanine concentration of 0.3% by weight, a N,N'-bis(3,5-xylyl)-perylimide concentration of 5.4% by weight and a charge carrier transport material concentration of 40.4% by weight.

Such monolayer organic photoconductors were less interesting than selenium-photoconductors, because of their poorer sensitivity, their very flat response to increasing exposure dose and their rather large fatigue.

However, the discovery that 2,4,7-trinitro-9-fluorenone (TNF) in poly(N-vinylcarbazole) (PVCz) formed a charge-transfer complex strongly improving the photosensitivity (ref. U.S. Pat. No. 3,484,237) opened the way for the use of organic photoconductors in copying machines that could compete with the selenium-based machines.

TNF acts as an electron acceptor whereas PVCz serves as electron donor. Films consisting of said charge transfer complex with TNF:PVCz in 1:1 molar ratio are dark brown, nearly black and exhibit high charge acceptance and low dark decay rates. However, the exposures required for 10% and 90% discharges differed by more than a factor of 10. Overall photosensitivity is comparable to that of amorphous selenium (ref. Schaffert, R. M. IBM J. Res. Develop., 15, 75 (1971).

Subsequently single layer photoconductive materials containing aggregates of photoconductors which are both positively and negatively chargeable were developed, e.g. consisting of ternary systems comprising a thio-pyrilium dye, a polycarbonate polymer and an aromatic molecule such as bis(4-N,N-diethylamino-2-methyl-phenyl)-phenylmethane. In 1979 Mey et al [J.Appl.Phys. 50, 8090 (1979)] published surface potential-exposure characteristics for such photoconductive recording materials with both negative and positive charging and for both emission-limited discharge and high-intensity flash. In all cases the exposures required for 10% and 90% discharges differed by more than a factor of 10.

A further search led to the discovery that if the sensitizing pigment in PEAM-layers were cast in a thin layer adjacent to a thicker layer solely consisting of transport molecules dissolved in an inert polymer binder or a polymeric charge transport material sensitivity comparable with selenium-photoconductors together with a much steeper response to increase in exposure dose and a much reduced fatigue were observed. Hackett showed this in 1971 [J.Chem.Phys. 55, 3178 (1971)] for the system X-phthalocyanine and PVK. Hackett found that photoconductivity was due to field dependent photogeneration of electron-hole pairs in the phthalocyanine and hole injection into the PVCz. The transport of the positive charges, i.e. positive hole-conduction proceeded easily in the PVCz layer. From that time on much research has been devoted to developing improved photoconductive systems wherein charge generation and charge transport materials are separate in two contiguous layers (see e.g. U.K. Pat No. 1,577,859). However, such functionally separated double layer photoconductors although generally exhibiting a steeper response to increasing exposure doses than single layer photoconductors still exhibit exposure doses for 10 and 90% discharge differing by a factor of 10 or more as shown in comparative examples furtheron.

It is an object of the present invention to provide electrophotographic recording materials with high photosensitivity which after being charged obtain a very sharp decrease in voltage [ΔV] within a particular narrow range [ΔE] of photo-exposure doses, viz. wherein the photo-exposure doses required for 10% and 90% discharge differ by a factor of 4.5 or less.

Other objects and advantages of the present invention will appear from the further description and examples.

In accordance with the present invention an electrophotographic recording material is provided which comprises on an electrically conductive support a negatively chargeable photoconductive recording layer which contains in an electrically insulating organic polymeric binder material at least one photoconductive n-type pigment substance and one or more p-type photoconductive charge transport substances, wherein said layer has a thickness in the range of 4 to 40 μm and comprises 8 to 80% by weight of said n-type pigment substance and 0.01 to 40% by weight of said p-type charge transport substance that is molecularly distributed in said electrically insulating organic polymeric binder material that has a volume resistivity of at least $10^{14}$ Ohm-m, and wherein said recording layer in electrostatically charged state requires for 10% and 90% discharge respectively exposures to conductivity increasing electromagnetic radiation that differ by a factor 4.5 or less, and wherein at least one p-type charge transport substance corresponds to a following general formula (I) to (V):

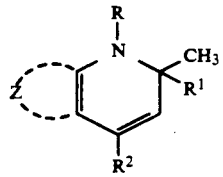

(I)

wherein:

R represents hydrogen or an aliphatic or cycloaliphatic group, e.g. a saturated aliphatic group or an unsaturated aliphatic group, including these groups substituted by non-ionic substituents, each of $R^1$ and $R^2$ (same or different) represents a $C_1$–$C_6$ alkyl group, e.g. methyl, ethyl, n-propyl, iso-propyl, n-butyl, isobutyl, n-pentyl and n-hexyl, or an aryl group, e.g. phenyl, and Z represents the atoms necessary to close an adjacent aromatic nucleus, e.g. benzene nucleus, or aromatic ring system including such nucleus or ring system substituted with one or more substituents of non-ionic character, e.g. substituted with one or more alkyl groups, one or more halogen atoms, e.g. F, Cl, Br or I, one or more cyano groups, nitro groups, alkoxy groups, e.g. methoxy, or amino groups, e.g. a monoalkylamino or a dialkylamino group, (a) hydrazone group(s), e.g. (a) formyl-1,1-diphenyl hydrazone group, a formyl-1-methyl-1-phenyl hydrazone group, (an) azo group(s), e.g. an azobenzene group, (an) enamine group(s), e.g. a group obtained by condensation of formaldehyde with a primary amine group;

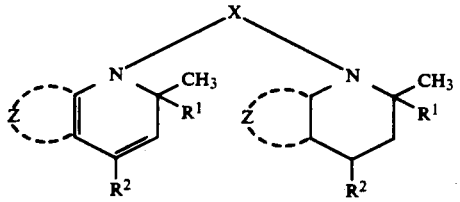

(II)

wherein:

X is a bivalent aliphatic or cycloaliphatic group, e.g. of the type that can be introduced by alkylation, e.g. an alkylene group, preferably an ethylene group, a substituted alkylene group or an alkylene chain interrupted by a bivalent aromatic group, e.g. a phenylene, naphthalene or anthracene group, or a bivalent aliphatic group wherein at least two carbon atoms are linked through a hetero-atom selected from the group consisting of oxygen, sulphur or nitrogen wherein nitrogen is substituted with a monovalent hydrocarbon group, e.g. an aryl group, and $R^1$, $R^2$ and Z have the same significance as described for general formula (I);

(III)

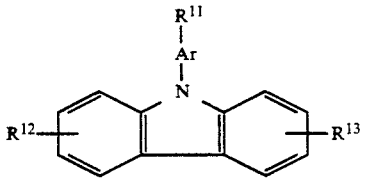

wherein:

$R^{11}$ is —$NR^4R^5$, wherein each of $R^4$ and $R^5$ (same or different) represents hydrogen, an aliphatic or cycloaliphatic group including said groups in substituted form, e.g. methyl or benzyl, or an aryl group e.g. phenyl, or $R^4$ and $R^5$ together represent the atoms necessary to complete a nitrogen-containing ring including such ring in substituted form, e.g. a carbazolyl ring, or $R^{11}$ is —N=N—Cp, wherein Cp is an azocoupler residue such as from an aromatic amine or an aromatic hydroxy compound used in azo coupling, or $R^{11}$ is —N=CH—$R^6$, wherein $R^6$ represents an aliphatic or cycloaliphatic group including said groups in substituted form, e.g. methyl or benzyl, or an aryl group, e.g. phenyl, Ar presents a bivalent aromatic group including said group in substituted form, e.g. a phenylene group or a biphenylene group, and each of $R^{12}$ and $R^{13}$ (same or different) represents hydrogen, halogen, an alkyl group, an alkoxy group or a —$NR^7R^8$ group, wherein each of $R^7$ and $R^8$ (same or different) represents an aryl group, a $C_1$-$C_{10}$ alkyl group including such alkyl group in substituted form, e.g. an aralkyl group, preferably methyl, ethyl or benzyl;

$R^{12}$, $R^{13}$ and $R^{14}$ have the same significance as described for general formula (III);

(V)

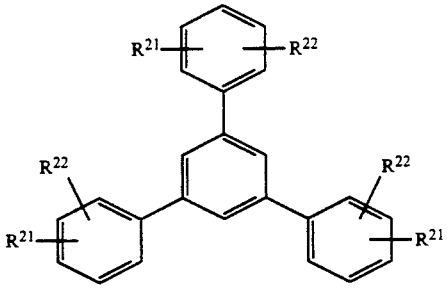

wherein:

$R^{21}$ represents a —$NR^{23}R^{24}$ group, wherein each of $R^{23}$ and $R^{24}$ (same or different) represents a $C_1$-$C_{10}$ alkyl group including said alkyl group in substituted form, e.g. an aralkyl group, preferably a benzyl group, or an alkoxycarbonyl substituted $C_1$-$C_{10}$ alkyl group, a cycloalkyl group, or an aryl group, and $R^{22}$ represents hydrogen, an alkyl group including a substituted alkyl group, e.g. methyl, alkoxycarbonyl substituted alkyl or halogen, e.g. chlorine.

According to an embodiment of a recording material of the present invention the recording layer contains a mixture of different p-type charge transport substances including at least one substance according to a general formula (I) to (V) defined hereinbefore. In said recording material the mixed charge transport substances have half-wave oxidation potentials, that do not differ by more than 0.4 V.

The half-wave oxidation potential measurements are carried out using a polarograph with rotating (500 rpm) platinum disc electrode and standard saturated calomel electrode (s.c.e.) at room temperature (20° C. using a product concentration of $10^{-4}$ mole and an electrolyte (tetrabutylammonium perchlorate) concentration of 0.1 mole in spectroscopic grade acetonitrile. Ferrocene was used as a reference substance having a half-wave oxidation potential of +0.430 V.

(IV)

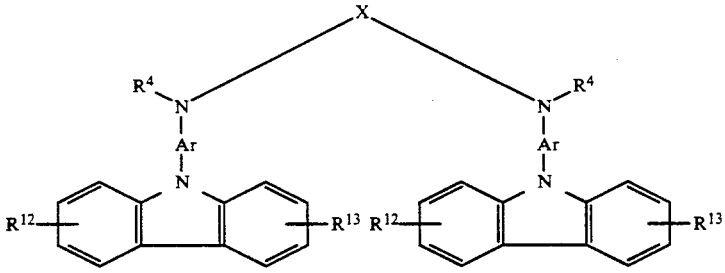

wherein:

X is a bivalent aliphatic or cycloaliphatic group of the type that can be introduced by alkylation e.g. an alkylene group, preferably an ethylene group, a substituted alkylene group or an alkylene group interrupted by a bivalent aromatic group, e.g. a phenylene, naphthalene or anthracene group, or a bivalent aliphatic group wherein at least two carbon atoms are linked through a hetero atom selected from the group consisting of oxygen, sulphur or nitrogen wherein nitrogen is substituted with a monovalent hydrocarbon group, e.g. an aryl group, and Examples of and preparation of p-type charge transport substances according to the above general formulae (I) or (II) are described in published European Patent Application 0 347 960.

Examples of and preparation of p-type charge transport substances according to the above general formulae (III) or (IV) are described in published European Patent Application 0 347 967.

Examples of and preparation of p-type charge transport substances according to the above general formula (V) are described in published European Patent Application 0 349 034.

Examples of suitable p-type charge transport substances that can be used dissolved in a binder, e.g. polycarbonate resin, in admixture with one or more p-type charge transport substances according to a general formula (I) to (V) as described above are low molecular weight substances from one of the following classes:

i) triphenylamines, e.g. tris(p-tolyl)amine as disclosed e.g. in U.S. Pat. No. 3,180,730;

ii) tetra-N,N,N',N'-tetraphenylbenzidines, e.g. N,N'-diphenyl-N,N'bis (3-methyl-phenyl)benzidine as disclosed e.g. in U.S. Pat. No. 4,265,990;

iii) hydrazones, e.g. 4-N,N'-diethylaminobenzaldehyde-1',1'-diphenyl hydrazone as disclosed e.g. in U.S. Pat. No. 4,150,987, 3-formyl-N-ethyl carbazole-1'-phenyl-1'-methyl hydrazone as disclosed e.g. in DE-OS 2 939 483 and 3-formyl-N-ethylcarbazole-1',1'-diphenyl hydrazone as disclosed e.g. in DE-OS 3 020 108;

iv) pyrazolines, e.g. as disclosed in U.S. Pat. No. 3,837,851;

v) oxadiazoles, e.g. 2,5-bis(4-N,N-diethylaminophenyl) oxadiazole-1,3,4 as disclosed e.g. in DBP 2 237 539;

vi) triarylmethanes, e.g. bis(4-N,N-diethylamino-2-methyl)phenyl methane as diclosed e.g. in DBP 1 237 900 and U.S. Pat. No. 4,127,412; or polymeric p-type charge transport substances from e.g. one of the following classes:

i) poly(N-vinylcarbazoles)

ii) poly(vinylpolycyclic aromatics), e.g. poly(9-vinylanthracene);

iii) pyrene-formaldehyde condensation polymers, e.g. as disclosed in DBP 1 218 286;

iv) polyxylylidenes e.g. as disclosed in J. Signal AM 5, 2, 111 (1977);

v) polymeric 1,2-dihydro-2,2,4-trimethylquinolines;

vi) polymeric tetraphenylbenzidines and triphenylamines, e.g. as disclosed in EP 295 113, 295 115, 295 125, 295 126 and 295 127.

The n-type pigment may be inorganic or organic and may have any colour including white. It is a finely divided substance dispersible in the organic polymeric binder of said photoconductive recording layer.

Optionally the support of said photoconductive recording layer is pre-coated with an adhesive and/or a blocking layer (rectifier layer) reducing or preventing positive hole charge injection from the conductive support into the photoconductive recording layer, and optionally the photoconductive recording layer is overcoated with an outermost protective layer, more details about said layers being given furtheron.

In accordance with a preferred embodiment said photoconductive recording layer has a thickness in the range of 5 to 35 μm and contains 10 to 70% by weight of said n-type pigment material(s) and 1 to 30% by weight of said p-type charge transport material(s).

In accordance with more preferred embodiments said recording layer has a thickness in the range of 5 to 35 μm and contains 50 to 80% by weight of said n-type pigment substance and 0.01 to 10% by weight of said p-type charge transport substance(s), or said recording layer has a thickness in the range of 5 to 35 μm and contains 15 to 30% by weight of said n-type pigment substance and between 20 and 30% by weight of said p-type charge transport substance(s).

By the term "n-type" material is understood a material having n-type conductance, which means that the photocurrent ($I_n$) generated in said material when in contact with an illuminated transparent electrode having negative electric polarity is larger than the photocurrent ($I_p$) generated when in contact with a positive illuminated electrode ($I_n/I_p>1$)

By the term "p-type" material is understood a material having p-type conductance, which means that the photocurrent ($I_p$) generated in said material when in contact with an illuminated transparent electrode having positive polarity is larger than the photocurrent ($I_n$) generated when in contact with a negative illuminated electrode ($I_p/I_n>1$), [ref. Hans Meier—Organic Semiconductors -Dark- and Photoconductivity of Organic Solids—Verlag Chemie (1974), p. 410, point 3.]

The electrically insulating binder has preferably a volume resistivity which is not higher than $10^{16}$ Ohm-m.

Examples of n-type pigments dispersible in the binder of the negatively chargeable recording layer of the electrophotographic recording material according to the present invention are organic pigments from one of the following classes:

a) perylimides, e.g. C.I. 71 130 (C.I.=Colour Index) described in DPB 2 237 539, b) polynuclear quinones, e.g. anthanthrones such as C.I. 59 300 described in DBP 2 237 678, c) quinacridones, e.g. C.I. 46 500 described in DBP 2 237 679, d) napthalene 1,4,5,8-tetracarboxylic acid derived pigments including the perinones, e.g. Orange GR, C.I. 71 105 described in DBP 2 239 923, e) n-type indigo and thioindigo dyes, e.g. Pigment Red 88, C.I. 73 312 described in DBP 2 237 680, f) perylene 3,4,9,10-tetracarboxylic acid derived pigments including condensation products with o-diamines as described e.g. in DAS 2 314 051, g) n-type polyazo-pigments including bisazo-, trisazo- and tetrakisazo-pigments, e.g. N,N'-bis(4-azobenzenyl)perylimide.

For use as binder material resins are selected preferably on the basis of optimal mechanical strength, adherence to any adjacent layer(s) and favourable electrical properties and if the active layer is at the same time the outermost layer also on the basis of reducing their surface energy and frictional coefficient in order to improve the resistance of the surface of the photosensitive recording material to toner smearing and abrasion and the ease with which untransferred toner can be removed.

Suitable binder material for use in the recording material of the present invention are organic resin materials, e.g. cellulose esters, acrylate and methacrylate resins, e.g. cyanoacrylate resin, polyvinyl chloride, copolymers of vinyl chloride, e.g. copolyvinyl chloride-/acetate and copolyvinylchloride/maleic anhydride, polyester resins, e.g. copolyesters of isophthalic acid and terephthalic acid with glycol, aromatic polycarbonate resins and polyester carbonate resins.

The recording layer as outermost layer can be endowed with a low surface adhesion and a low frictional coefficient by the incorporation therein of a resin comprising a block copolyester or copolycarbonate having a fluorinated polyether block as described in U.S. Pat. No. 4,772,526.

A polyester resin particularly suited for use in combination with aromatic polycarbonate binders is DYNAPOL L 206 (registered trade mark of Hüls A.G. W-Germany for a copolyester of terephthalic acid and isophthalic acid with ethylene glycol and neopentyl glycol, the molar ratio of tere- to isophthalic acid being 3/2). Said polyester resin improves the adherence to aluminium that may form a conductive coating on the support of the recording material.

Suitable aromatic polycarbonates can be prepared by methods such as those described by D. Freitag, U. Grigo, P. R. Müller and W. Nouvertné in the Encyclopedia of Polymer Science and Engineering, 2nd ed., Vol. II, pages 648–718, (1988) published by Wiley and Sons Inc., and have one or more repeating units within the scope of the following general formula:

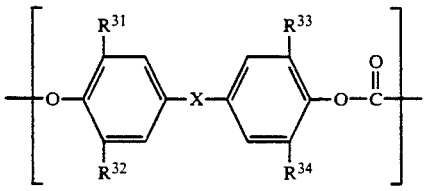

wherein:

X represents S, $SO_2$,

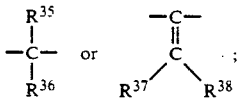

$R^{31}$, $R^{32}$, $R^{33}$, $R^{34}$, $R^{37}$, and $R^{38}$ each represents (same or different) hydrogen, halogen, an alkyl group or an aryl group, and $R^{35}$ and $R^{36}$ each represent (same or different) hydrogen, an alkyl group, an aryl group or together represent the necessary atoms to close a cycloaliphatic ring, e.g. cyclohexane ring.

Aromatic polycarbonates having a molecular weight in the range of 10,000 to 200,000 are preferred. Suitable polycarbonates having such a high molecular weight are sold under the registered trade mark MAKROLON of Farbenfabriken Bayer AG, W-Germany.

MAKROLON CD 2000 (registered trade mark) is a bisphenol A polycarbonate with molecular weight in the range of 12,000 to 25,000 wherein $R^{31}=R^{32}=R^{33}=R^{34}=H$, X is $R^{35}-C-R^{36}$ with $R^{35}=R^{36}=CH_3$.

MAKROLON 5700 (registered trade mark) is a bisphenol A polycarbonate with molecular weight in the range of 50,000 to 120,000 wherein $R^{31}=R^{32}=R^{33}=R^{34}=H$, X is

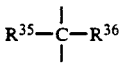

with $R^{35}=R^{36}=CH_3$.

Further useful binder resins are silicone resins, polystyrene and copolymers of styrene and maleic anhydride and copolymers of butadiene and styrene.

The photoconductive recording layer may contain further additives such as spectral sensitizing agents known in the art, e.g. (poly)methine dyes, for enlarging the spectral sensitivity of the applied photoconductive compounds, and compounds acting as stabilising agents against deterioration by ultra-violet radiation, so-called UV-stabilizers, e.g. benztriazoles.

For controlling the viscosity of the coating compositions and controlling their optical clarity silicone oils may be used.

An adhesive layer and/or blocking layer being optionally present between the conductive support and the photoconductive recording layer may contain or consist of one or more of e.g. a polyester, a polyamide, nitrocellulose, hydrolysed silane, or aluminium oxide. The total layer thickness of said layer(s) is preferably not more than 2 micron.

The photoconductive recording layer may be coated optionally with a thin outermost protective layer to endow its surface with improved abrasion resistance, a reduced frictional coefficient, reduced tendency to toner smearing and more easy removal of untransferred toner. Preferably said outermost layer is a binder layer containing at least one p-type transport substance being not admixed with said n-type photoconductive pigment(s). The thickness of said outermost layer is preferably not larger than 7 μm, more preferably 2 μm. The concentration of said p-type charge transport substance(s) in the outermost layer preferably does not exceed 50 wt % to avoid excessive abrasion in use.

Suitable resins for use in a protective layer with low friction coefficient are block copolyester or copolycarbonate resins having a fluorinated polyether block as described e.g. in U.S. Pat. No. 4,772,526, or are copolymers of tetrafluoroethene or hexafluoropropene, optionally in combination with resins compatible therewith, e.g. cellulose esters, acrylate and methacrylate resins, e.g. cyanoacrylate resin, polyvinyl chloride, copolymers of vinyl chloride, e.g. copolyvinyl chloride/acetate and copolyvinyl chloride/maleic anhydride, polyester resins, aromatic polycarbonate resins or polyester-carbonate resins.

The conductive support may be made of any suitable conductive material. Typical conductors include aluminum, steel, brass and paper and resin materials incorporating or coated with conductivity enhancing substances, e.g. vacuum-deposited metal, dispersed carbon black, graphite and conductive monomeric salts or a conductive polymer, e.g. a polymer containing quaternized nitrogen atoms as in Calgon Conductive polymer 261 (trade mark of Calgon Corporation, Inc., Pittsburgh, Pa., U.S.A.) described in U.S. Pat. No. 3,832,171.

The support may be in the form of a foil, web or be part of a drum.

An electrophotographic recording process according to the present invention comprises the steps of:

(1) overall negatively electrostatically charging, e.g. with corona-device, the recording material of the present invention, (2) image-wise photo-exposing the recording material according to the present invention thereby obtaining a latent electrostatic image.

The development of the latent electrostatic image commonly occurs preferably with finely divided electrostatically attractable material, called toner particles that are attracted by coulomb force to the electrostatic charge pattern. The toner development is a dry or liquid toner development known to those skilled in the art.

In positive-positive development toner particles deposit on those areas of the charge carrying surface which are in positive-positive relation to the original image. In reversal development, toner particles migrate and deposit on the recording surface areas which are in negative-positive image value relation to the original. In the latter case the areas discharged by photo-exposure obtain by induction through a properly biased developing electrode a charge of opposite charge sign with respect to the charge sign of the toner particles so that the toner becomes deposited in the photo-exposed areas that were discharged in the imagewise exposure (ref.: R. M. Schaffert "Electrophotography"—The Focal Press—London, New York, enlarged and revised edition 1975, p. 50–51 and T. P. Maclean "Electronic Imaging" Academic Press—London, 1979, p. 231).

According to a particular embodiment electrostatic charging, e.g. by corona, and the imagewise photo-exposure proceed simultaneously.

Residual charge after toner development may be dissipated before starting a next copying cycle by overall exposure and/or alternating current corona treatment.

Recording materials according to the present invention depending on the spectral sensitivity of the photoconductive recording layer may be used in combination with all kinds of photon-radiation, e.g. light of the visible spectrum, infra-red light, near ultra-violet light and likewise X-rays when electron-positive hole pairs can be formed by said radiation in the recording layer. Thus, they can be used in combination with incandescent lamps, fluorescent lamps, laser light sources or light emitting diodes by proper choice of the spectral sensitivity of the charge generating substance or mixtures thereof.

The toner image obtained may be fixed onto the recording material or may be transferred to a receptor material to form thereon after fixing the final visible image.

A recording material according to the present invention showing a particularly low fatigue effect can be used in recording apparatus operating with rapidly following copying cycles including the sequential steps of overall charging, imagewise exposing, toner development and toner transfer to a receptor element.

The evaluations of electrophotographic properties determined on the recording materials of the following examples relate to the performance of the recording materials in an electrophotographic process with a reusable photoreceptor. The measurements of the performance characteristics were carried out as follows:

Two procedures were used for evaluating the discharge as a function of exposure: a routine sensitometric measurement in which the discharge was obtained for 8 different exposures including zero exposure and a more refined measurement in which the discharge was obtained for 360 different exposures in a single drum rotation.

In the routine sensitometric measurement the photoconductive recording sheet material was mounted with its conductive backing on an aluminium drum which was earthed and to which the conductive backing had been connected. The drum was rotated at a circumferential speed of 5 cm/s and the recording material sequentially charged with a negative corona at a voltage of −4.6 kV operating with a corona current of about 1 μA per cm of corona wire, exposed (simulating imagewise exposure) with monochromatic light obtained from a monochromator positioned at the circumference of the drum at an angle of 45° with respect to the corona source for 400 ms, the voltage measured with an electrometer probe positioned at an angle of 180° with respect to the corona source and finally post-exposed with a halogen lamp producing 54,000 mJ/m2 positioned at an angle of 270° with respect to the corona source before starting a new copying cycle.

Each measurement consisted of 40 copying cycles with the exposure being changed every 5 copying cycles by using a constant light intensity ($I_o$) initially using no light attenuating filter, and thereupon sequentially a filter with an optical density of 0.5, a filter with an optical density of 1.0, filters with a total optical density of 1.5, a filter with an optical density of 2.0, filters with a total optical density of 2.5, filters with a total optical density of 3.0 and finally a shutter to shut off the exposing light. This gives the discharges for 8 predetermined exposures. The charging level (CL) was taken as the average charging level over the last 5 cycles at zero exposure.

In the refined sensitometric measurement the photoconductive recording sheet material is mounted on an aluminium drum as described above. The drum was rotated at a circumferential speed of 2 cm/s and the recording material sequentially charged with a negative corona at a voltage of −4.3 kV operating with a corona current of ca 0.5 μA per cm of corona wire, exposed (simulating image-wise exposure) with monochromatic light obtained from a monochromator positioned at the circumference of the drum at an angle of 40° with respect to the corona source for 500 ms, the voltage measured with an electrometer probe positioned at an angle of 90° with respect to the corona source and finally post-exposed with a halogen lamp producing 2,000 mJ/m2 positioned at an angle of 300° with respect to the corona source before starting a new copying cycle. Each measurement consisted of a single copying cycle in which a density disc with continuously varying optical density from an optical density of 0 to an optical density of 2.1 over a sector of 210° was rotated in front of the monochromator synchronously with the rotation of the drum with the surface potential being measured every degree of rotation. This gives the discharges for 360 predetermined exposures and hence a complete sensitometric curve, whereas the routine measurement only gives 8 points on that curve.

For a given corona voltage, corona current, separating distance of the corona wires to recording surface and drum circumferential speed the charging level CL is only dependent upon the thickness of the charge transport layer and its specific resistivity. In practice CL expressed in volts should be preferably $\geqq 30$ d, where d is the thickness in μm of the charge transport layer.

In the accompanying FIGS. 1 to 21 sensitometric curves are given with in the abscissa logarithmic values of exposure dose at 540 nm [log E = log I.t] expressed in $mJ/m^2$ and in the ordinate voltage values [V] measured on the charged recording layer during the exposure using increasing exposure doses at constant exposure time.

The following examples further illustrate the present invention. All parts, ratios and percentages are by weight unless otherwise stated.

COMPARATIVE EXAMPLES 1 TO 3

In the photoconductive recording materials of COMPARATIVE EXAMPLES 1 to 3 a 100 μm thick polyester layer precoated with a vacuum-deposited conductive layer of aluminium was doctor-blade coated with a dispersion of N,N'dimethyl perylimide C.I. Pigment Red 189, C.I. No 71130 (represented as PIM in Table 1) containing the charge transport material 2,5-bis(4-N,N-diethylaminophenyl)oxdiazole-1,3,4 (represented as OXA in Table 1). In said Table 1 also the concentrations (conc.) and layer thicknesses in μm are given.

Said dispersions were prepared by mixing for 72 hours in a ball mill N,N'dimethylperylimide, an aromatic polycarbonate MAKROLON CD 2000 (registered trade mark), indicated in Table 1 as P1 in the weight percentages given in said Table 1 in dichloromethane at a solids concentration of 16.2% by weight and subsequently adding 2,5-bis(4-N,N-diëthylaminophenyl)-oxidiazole-1,3,4 and a polyester adhesion-promoting additive DYNAPOL L206 (registered trade mark), indicated in Table 1 as P2 in the weight percentages given in said Table 1 with additional dichloromethane and mixing for a further 30 minutes. The dispersion was then cast without further dilution with dichloromethane and the resulting layer dried for 16 hours at 50° C.

COMPARATIVE EXAMPLE 1 has the same N,N'dimethylperylimide and 2,5-bis(4-N,N-diethylaminophenyl)oxidiazol-1,3,4 concentrations as in EXAMPLE 1 of published EP-A 161 648 corresponding with U.S. Pat. No. 4,668,600 and binder types described as preferred in said documents.

The characteristics of the thus obtained photosensitive materials were determined as described above. The sensitivity to monochromatic 540 nm light exposure is expressed as the % discharge at an exposure ($I_{540}t$) of 38 mJ/m$^2$ and the steepness of the discharge exposure dependence is expressed as the % discharge observed between exposures ($I_{540}t$) of 12 mJ/m$^2$ and 38 mJ/m$^2$, a factor of 3.16 difference in exposure. The results are given in Table 1.

TABLE 1

| Comparative Example no. | PIM conc. [wt %] | OXA conc. [wt %] | P1 conc. [wt %] | P2 conc. [wt %] | Layer thickness [μm] | CL [V] | % discharge for $I_{540}t$ of 38 mJ/m2 | % discharge between $I_{540}t$'s of 12 and 38 mJ/m2 |
|---|---|---|---|---|---|---|---|---|
| 1 | 15 | 10 | 67.5 | 7.5 | 13 | −281 | 12.8* | 28.1 |
| 2 | 15 | 8 | 69.3 | 7.7 | 13 | −232 | 0* | 19.4 |
| 3 | 15 | 5 | 72 | 8 | 13 | −281 | 5.7* | 17.8 |

*CL fluctuation during measurement.

EXAMPLES 1 to 22 and COMPARATIVE EXAMPLES 4 to 13

In the production of the photosensitive recording materials a 100 μm thick polyester film precoated with a vacuum-deposited conductive layer of aluminium was doctor-blade coated with a dispersion of charge generating pigment containing charge transport material, the respective compositions being given in Table 2, to thicknesses in μm also given in Table 2.

Said dispersion was prepared by mixing for 15 minutes in a pearl mill 4,10-dibromoanthanthrone (DBA), 1,2-bis(1,2-dihydro-2,2,4-trimethylquinolin-1-yl)ethane (Bisflectol), a polyester adhesion-promoting additive DYNAPOL L206 (registered trade mark), indicated in Table 2 as P2, and an aromatic polycarbonate MAKROLON CD 2000 (registered trade mark), indicated in Table 2 as P1 in the weight percentages given in said Table 2 using dichloromethane as coating solvent (17.16 g/g DBA). The dispersion was cast without further dilution with dichloromethane and the resulting layer dried for 15 hours at 50° C.

The characteristics of the thus obtained photosensitive recording materials were determined as described above. The sensitivity to monochromatic 540 nm light exposure is expressed as the % discharge at an exposure ($I_{540}t$) of 36.6 mJ/m2 and the steepness of the discharge-exposure dependence is expressed as the % discharge observed between exposures ($I_{540}t$) of 11.6 mJ/m2 and 36.6 mJ/m2, a factor of 3.16 difference in exposure. The results are given in Table 2.

TABLE 2

| Example no. | DBA conc. [wt %] | Bis-flectol conc. [wt %] | P1 conc. [wt %] | P2 conc. [wt %] | layer thickness [μm] | CL [V] | % discharge for $I_{540}t$ = 36.6 mJ/m2 | % discharge between $I_{540}t$'s of 11.6 and 36.6 mJ/m2 |
|---|---|---|---|---|---|---|---|---|
| 1 | 30 | 5 | 58.5 | 6.5 | 12 | −730 | 90.0 | 81.1 |
| 2 | 30 | 10 | 54 | 6.0 | 11 | −679 | 94.7 | 79.4 |
| 3 | 30 | 20 | 45 | 5.0 | 10 | −625 | 97.4 | 71.0 |
| 4 | 30 | 30 | 36 | 4.0 | 10 | −574 | 93.0 | 56.4 |
| 5 | 30 | 40 | 27 | 3.0 | 13 | −666 | 72.7 | 40.0 |
| 6 | 25 | 5 | 63 | 7.0 | 11 | −704 | 79.0 | 68.9 |
| 7 | 25 | 10 | 58.5 | 6.5 | 10 | −758 | 95.6 | 79.0 |
| 8 | 25 | 15 | 54 | 6.0 | 10 | −667 | 96.0 | 75.2 |
| 9 | 25 | 25 | 45 | 5.0 | 11 | −640 | 95.8 | 70.9 |
| 10 | 25 | 30 | 40.5 | 4.5 | 8 | −524 | 96.6 | 60.9 |
| 11 | 25 | 40 | 31.5 | 3.5 | 10 | −515 | 92.6 | 53.0 |
| 12 | 20 | 10 | 63 | 7.0 | 12 | −683 | 89.5 | 72.2 |
| 13 | 20 | 15 | 58.5 | 6.5 | 12 | −768 | 95.1 | 75.8 |
| 14 | 20 | 20 | 54 | 6.0 | 12 | −718 | 93.6 | 73.7 |
| 15 | 20 | 30 | 45 | 5.0 | 11 | −636 | 90.3 | 63.1 |
| 16 | 20 | 40 | 36 | 4.0 | 13 | −641 | 88.6 | 58.5 |
| 17 | 15 | 10 | 67.5 | 7.5 | 12 | −703 | 81.8 | 66.1 |
| 18 | 15 | 15 | 63 | 7.0 | 12 | −784 | 72.4 | 55.4 |
| 19 | 15 | 20 | 58.5 | 6.5 | 11 | −697 | 66.1 | 44.6 |
| 20 | 16 | 24 | 54 | 6.0 | 10 | −617 | 82.2 | 54.5 |
| 21 | 15 | 30 | 49.5 | 5.5 | 8 | −606 | 81.2 | 48.2 |
| 22 | 15 | 40 | 40.5 | 4.5 | 8 | −572 | 91.6 | 49.3 |

TABLE 2-continued

| Comparative example no. | DBA conc. [wt %] | Bis-flectol conc. [wt %] | P1 conc. [wt %] | P2 conc. [wt %] | layer thickness [μm] | CL [V] | % discharge for $I_{540}t$ = 36.6 mJ/m2 | % discharge between $I_{540}t$'s of 11.6 and 36.6 mJ/m2 |
|---|---|---|---|---|---|---|---|---|
| 4 | 40 | 0 | 54.0 | 6.0 | 12 | −849 | 4.9 | 2.8 |
| 5 | 25 | 0 | 67.5 | 7.5 | 12 | −817 | 2.8 | 2.1 |
| 6 | 20 | 50 | 27.0 | 3.0 | 11 | −654 | 69.7 | 36.4 |
| 7 | 15 | 50 | 31.5 | 3.5 | 10 | −638 | 75.7 | 37.6 |
| 8 | 10 | 30 | 54.0 | 6.0 | 12 | −765 | 64.3 | 31.9 |
| 9 | 10 | 40 | 45.0 | 5.0 | 12 | −766 | 66.2 | 31.6 |
| 10 | 10 | 50 | 36.0 | 4.0 | 13 | −742 | 72.2 | 32.9 |
| 11 | 5 | 30 | 58.5 | 6.5 | 22 | −1000 | 48.4 | 24.1 |
| 12 | 5 | 40 | 49.5 | 5.5 | 22 | −1024 | 58.6 | 25.9 |
| 13 | 5 | 50 | 40.5 | 4.5 | 22 | −1030 | 68.7 | 29.4 |

A sensitometric measurement was carried out on the photosensitive recording material of comparative Example 9 using the refined sensitometric measurement techniques described above. The resulting sensitometric curve is shown in FIG. 1 with exposures required for 10% and 90% discharges differing by a factor of greater than 10.

EXAMPLES 23 to 27 and COMPARATIVE EXAMPLES 14 and 15

The photosensitive recording materials of EXAMPLES 23 to 27 and COMPARATIVE EXAMPLES 14 and 15 were produced as described for EXAMPLES 1 to 22 with the compositions and layer thicknesses given together with the % discharges at an exposure ($I_{540}t$) of 36.6 mJ/m2 and the % discharges observed between exposures ($I_{540}t$) of 11.6 mJ/m2 and 36.6 mJ/m2 are given in Table 3.

TABLE 3

| Example no. | DBA conc. [wt %] | Bis-flectol conc. [wt %] | P1 conc. [wt %] | P2 conc. [wt %] | layer thickness [μm] | CL [V] | % discharge for $I_{540}t$ = 36.6 mJ/m2 | % discharge between $I_{540}t$'s of 11.6 and 36.6 mJ/m2 |
|---|---|---|---|---|---|---|---|---|
| 23 | 25 | 10 | 58.5 | 6.5 | 4 | −486 | 78.8 | 60.3 |
| 24 | 25 | 10 | 58.5 | 6.5 | 6 | −591 | 87.3 | 71.9 |
| 7 | 25 | 10 | 58.5 | 6.5 | 10 | −758 | 95.6 | 79.0 |
| 25 | 25 | 10 | 58.5 | 6.5 | 12 | −730 | 93.8 | 77.7 |
| 26 | 25 | 10 | 58.5 | 6.5 | 15 | −826 | 96.0 | 73.5 |
| 27 | 25 | 10 | 58.5 | 6.5 | 18 | −997 | 94.2 | 71.7 |
| Comparative example | | | | | | | | |
| 14 | 25 | 10 | 58.5 | 6.5 | 2.5 | −300 | 68.3 | 49.3 |
| 15 | 25 | 10 | 58.5 | 6.5 | 27 | −981 | 81.0 | 55.7 |

EXAMPLE 28

The photosensitive recording material of EXAMPLE 28 was produced as described for EXAMPLE 7 except that 1,2-bis(6-ethoxy-1,2-dihydro-2,2,4-trimethylquinolin-1-yl)ethane was used as the charge transport material instead of 1,2-bis(1,2-dihydro-2,2,4-trimethylquinolin-1-yl)ethane. The layer thickness was 12 μm. This photosensitive recording material exhibited 89.8% discharge upon $I_{540}t$ exposure of 36.6 mJ/m2 and 77.2% discharge between $I_{540}t$ exposures of 11.6 mJ/m2 and 36.6 mJ/m2.

EXAMPLE 29

The photosensitive recording material of EXAMPLE 29 was produced as described for EXAMPLE 7 except that N,N'-bis(3,5-xylyl) perylimide C.I. Pigment Red 149 and C.I. 71 137 was used as the sensitizing pigment instead of 4,10-dibromoanthanthrone [C.I. Pigment Red 168 and C.I. 59 300]. The layer thickness was 13 μm. This photosensitive recording material exhibited 93.3% discharge upon $I_{540}t$ exposure of 36.6 mJ/m$^2$ and 90.6% discharge between $I_{540}t$ exposures of 11.6 mJ/m2 and 36.6 mJ/m2. The sensitometric curve obtained using the refined sensitometric measurement technique described above is shown in FIG. 2.

EXAMPLE 30

The photosensitive recording material of EXAMPLE 30 was produced as described for EXAMPLE 7 except that N,N'-bis(4-ethoxyphenyl)perylimide C.I. Pigment Red 123 and C.I. 71 145 was used as the sensitizing pigment instead of 4,10-dibromoanthanthrone C.I. Pigment Red 168 and C.I. 59 300. The layer thickness was 13 μm. This photosensitive recording material exhibited 19.2% discharge upon $I_{540}t$ exposure of 36.6 mJ/m$^2$ and 64.4% discharge between $I_{540}t$ exposures of 36.6 mJ/m2 and 116 mJ/m2.

EXAMPLE 31

The photosensitive recording material of EXAMPLE 31 was produced as described for EXAMPLE 7 except that the binder resin consisted of 100% of DYNAPOL L206 (registered trade mark) instead of a mixture of DYNAPOL L206 (registered trade mark) and an aromatic polycarbonate MAKROLON CD 2000 (registered trade mark). The layer thickness was 11 μm. This photosensitive recording material exhibited 94.3% discharge upon $I_{540}t$ exposure of 36.6 mJ/m$^2$ and 75.7% discharge between $I_{540}t$ exposures of 11.6 mJ/m2 and 36.6 mJ/m2.

EXAMPLE 32

The photosensitive recording material of EXAMPLE 32 was produced as described for EXAMPLE 7 except that the 100 μm thick polyester film was precoated with a vacuum-deposited conductive layer of aluminium and was doctor blade coated with a 1% solution of γ-aminopropyltriethoxy silane in aqueous methanol. The solvent was evaporated and the layer cured at 100° C. for 30 minutes prior to the coating of the photoconductive recording layer. The photoconductive layer had a thickness of 12 μm and exhibited 93.8% discharge upon $I_{540}t$ exposure of 36.6 mJ/m$^2$ and 77.7% discharge between $I_{540}t$ exposures of 11.6 mJ/m2.

EXAMPLE 33

The photosensitive recording material of EXAMPLE 33 was produced as described for EXAMPLE 32 except that the binder resin in the photoconductive layer was 100% aromatic polycarbonate MAKROLON CD 2000 (registered trade mark) instead of a mixture of DYNAPOL L206 (registered trade mark) and MAKROLON CD 2000 (registered trade mark). The layer thickness was 12 μm. This photosensitive recording material exhibited 85.3% discharge upon $I_{540}t$ exposure of 36.6 mJ/m$^2$ and 63.3% discharge between $I_{540}t$ exposures of 11.6 mJ/m2 and 36.6 mJ/m2.

COMPARATIVE EXAMPLE 16

A double layer functionally separated photosensitive recording material was produced by first doctor blade-coating a 100 μm thick polyester film precoated with a vacuum-deposited conductive layer of aluminium with a 1% solution of γ-aminopropyltriethoxy silane in aqueous methanol. After solvent evaporation and curing at 100° C. for 30 minutes, the thus obtained adhesion/-blocking layer was doctor blade-coated with a dispersion of charge generating pigment to a thickness of 0.6 μm.

Said dispersion was prepared by mixing 2 g of 4,10-dibromoanthanthrone (C.I. Pigment Red 168, C.I. 59 300), 2 g of aromatic polycarbonate MAKROLON CD 2000 (registered trade mark) and 46 g of dichloromethane for 24 hours in a ball mill. Said dispersion was cast without further dilution.

The applied layer was dried for 15 minutes at 80° C. and then overcoated using a doctor blade coater with a filtered solution of charge transporting material and binder consisting of 2 g of 1,2-bis(1,2-dihydro-2,2,4-trimethyl-quinolin-1-yl)ethane, 2 g of aromatic polycarbonate MAKROLON CD 2000 (registered trade mark) and 21 g of dichloromethane to a thickness of 15 μm. This layer was then dried at 50° C. for 16 hours.

Figure 3:
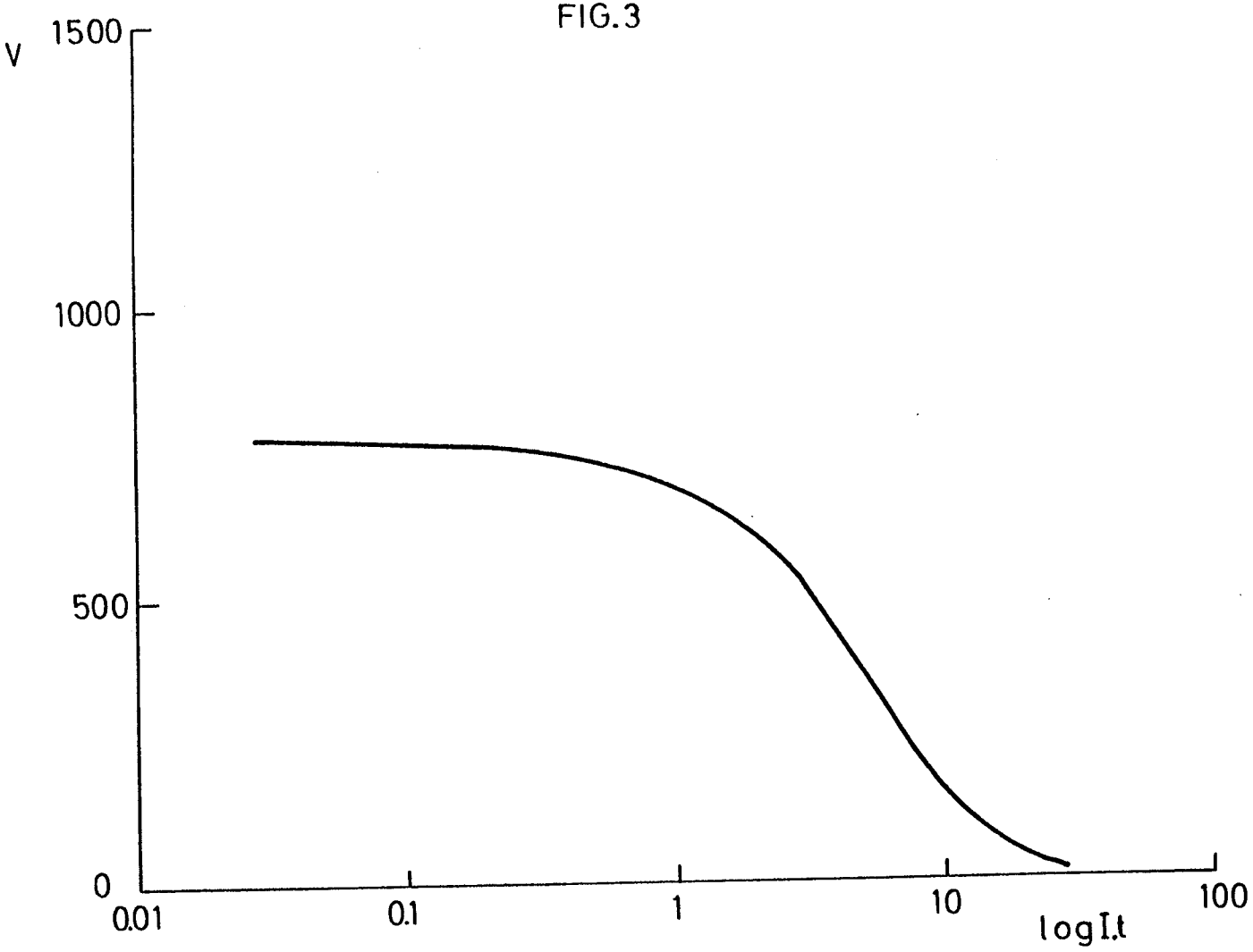
Figure 4:
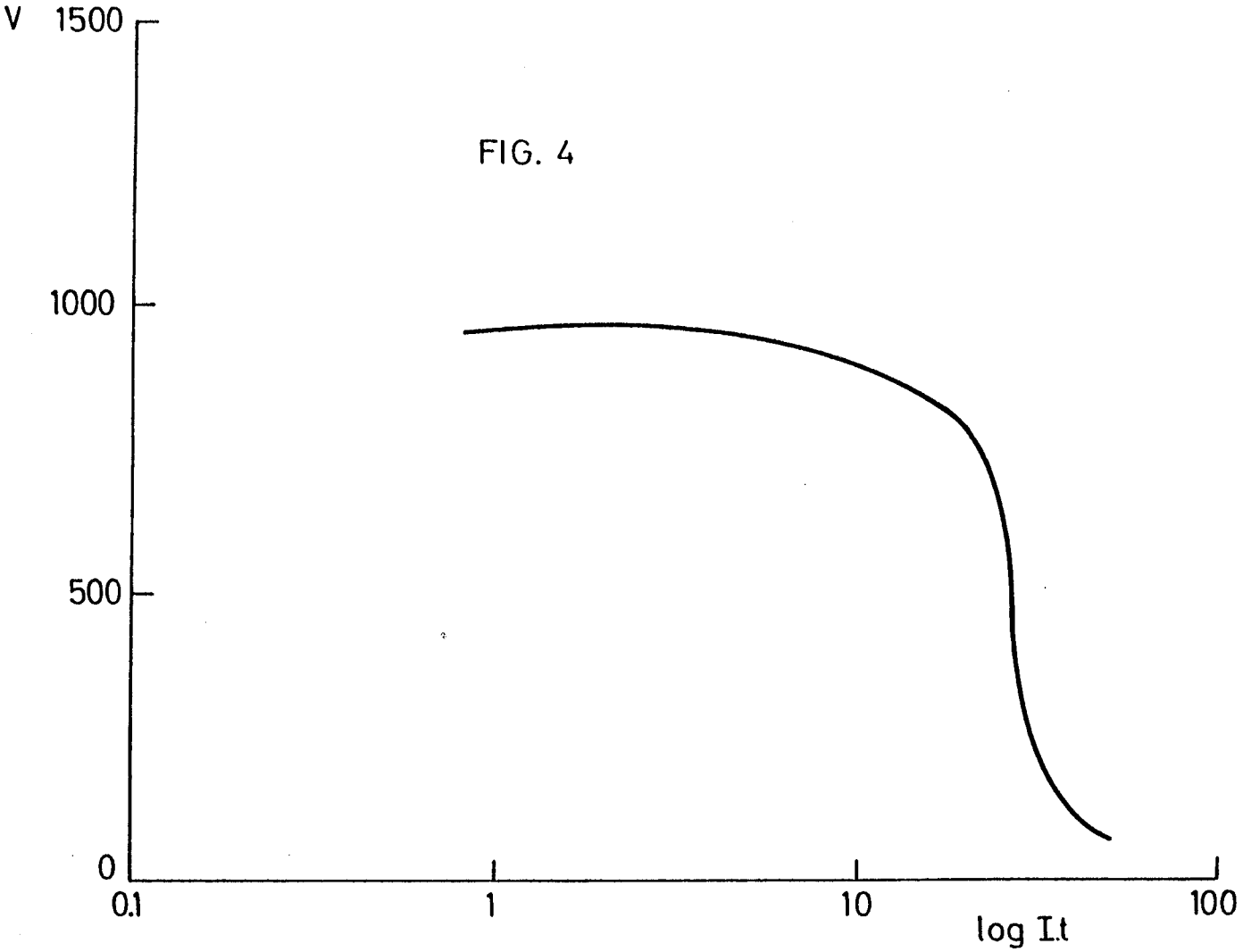
Figure 5:
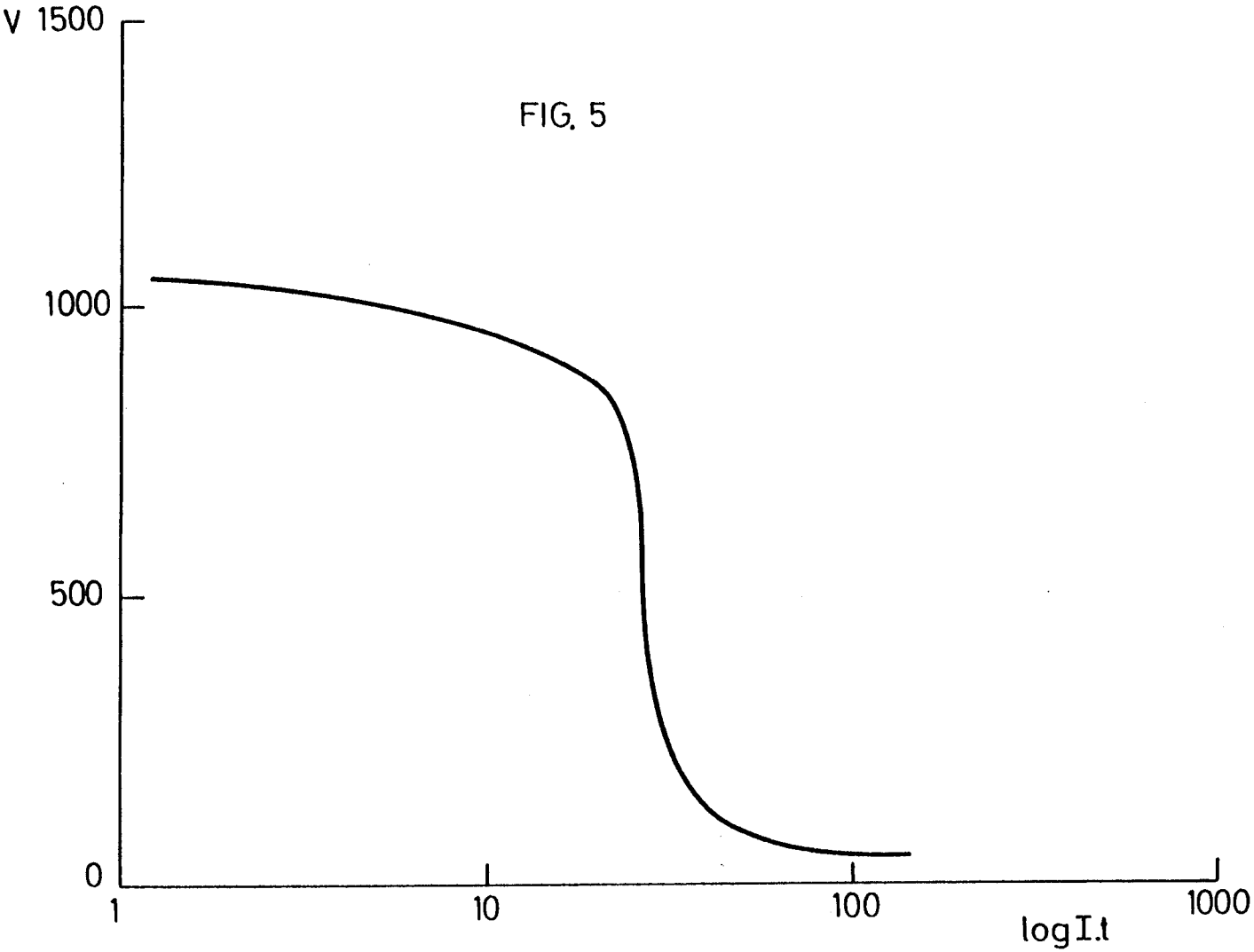

A sensitometric measurement was carried out on this photosensitive recording material using the refined sensitometric measurement techniques described above. The resulting sensitometric curve typical of those obtained for double layer functionally separated photosensitive recording materials is shown in FIG. 3 with exposures required for 10% and 90% discharges differing by a factor of greater than 10.

COMPARATIVE EXAMPLE 17

The photosensitive recording material of COMPARATIVE EXAMPLE 17 was produced as described for EXAMPLE 7 except that p-conducting X-phthalocyanine was used as the sensitizing pigment instead of 4,10-dibromoanthanthrone [C.I. Pigment Red 168 and C.I. 59 300] and the layer was 14 μm thick. This photosensitive recording material exhibited 0% discharge upon $I_{650}t$ exposure of 83.6 mJ/m2.

EXAMPLES 34 and 35

The photosensitive layers of EXAMPLES 34 and 35 were produced as described for EXAMPLE 7 except that the 4,10-dibromo-anthanthrone (DBA) was dispersed by mixing with 5 wt % of the aromatic polycarbonate MAKROLON CD 2000 (registered trade mark) in dichloromethane for 15 minutes in a pearl mill and subsequently adding the rest of the aromatic polycarbonate, the polyester adhesion-promoting additive and more dichloromethane before mixing for a further 5 minutes in the pearl mill.

In the case of EXAMPLE 35 a 15 μm thick photosensitive layer was overcoated with a solution of 50 wt % 1,2-bis(1,2-dihydro-2,2,4-trimethyl-quinolin-1-yl)ethane and 50 wt % of an aromatic polycarbonate MAKROLON CD 2000 (registered trade mark) in dichloromethane to a thickness of 4 μm after drying for 16 hours at 50° C.

The characteristics of the thus obtained photosensitive recording materials were determined as described above. The sensitivity to monochromatic 540 nm light exposure is expressed as the % discharge at an exposure ($I_{540}t$) of 36.6 mJ/m$^2$ and the steepness of the charge-exposure dependence is expressed as the % discharge observed between exposures ($I_{540}t$) of 11.6 mJ/m$^2$ and 36.6 mJ/m$^2$. The results are given in Table 4.

TABLE 4

| Example no. | Photo-sensitive layer thickness [μm] | Protective layer thickness [μm] | CL [V] | % discharge for $I_{540}t$ = 36.6 mJ/m2 | % discharge between $I_{540}t$'s of 11.6 and 36.6 mJ/m2 |
|---|---|---|---|---|---|
| 34 | 14 | 0 | −835 | 95.0 | 85.3 |
| 35 | 15 | 4 | −947 | 95.9 | 79.5 |

Sensitometric measurements were also carried out on these photosensitive recording materials using the refined sensitometric measurement techniques described above. The resulting sensitometric curves are shown for Examples 34 and 35 in FIGS. 4 and 5 respectively.

EXAMPLE 36

The photosensitive recording material of EXAMPLE 36 was produced as described for EXAMPLE 35 except that 15 wt % of trans perinone [C.I. Pigment Orange 43, C.I. 71 105] was used as the sensitizing pigment instead of 25 wt % of 4,10-dibromoanthanthrone [C.I. Pigment Red 168, C.I. 59 300]. The layer thickness was 13 μm. This photosensitive recording material exhibited 93.3% discharge upon $I_{540}t$ exposure of 36.6 mJ/m$^2$ and 80.7% discharge between $I_{540}t$ exposures of 3.66 mJ/m$^2$ and 11.6 mJ/m$^2$.

EXAMPLES 37 TO 45 AND COMPARATIVE EXAMPLES 18 AND 19

The photosensitive recording materials of EXAMPLES 37 to 45 and of COMPARATIVE EXAMPLES 18 and 19 were produced as described for EXAMPLE 38 except that the concentration of 1,2-bis-(dihydro-2,2,4-trimethyl-quinolin-1-yl)ethane (called herein Bisflectol) varied from 50 to 0 wt % as given in Tables 5A and 5B and the concentrations of binders varied appropriately as also given in Tables 5A and 5B together with the layer thicknesses.

The characteristics of the thus obtained photosensitive recording materials were determined as described above and are given in Tables 5A and 5B. The sensitivity to monochromatic 540 nm light exposure is expressed as the % discharge at an exposure ($I_{540}t$) of 36.6 mJ/m$^2$ and the steepness of the discharge-exposure dependence is expressed as the % discharge observed between exposures ($I_{540}t$) of 11.6 mJ/m$^2$ and 36.6 mJ/m$^2$ (see Table 5A), or 36.6 mJ/m$^2$ and 116 mJ/m$^2$ or 76 mJ/m$^2$ and 240 mJ/m$^2$ (see Table 5B) depending upon the sensitivity of the photosensitive recording material.

EXAMPLES 46 TO 49 AND COMPARATIVE EXAMPLE 20

The photosensitive recording materials of EXAMPLES 46 to 49 and of COMPARATIVE EXAMPLE 20 were produced as described for EXAMPLE 1 except that the concentration of 4,10-dibromo-anthanthrone varied from 40 to 85 wt % as given in Tables 6A and 6B and the concentrations of the binder varied appropriately as also given in said Tables. The layer thicknesses are also given in Tables 6A and 6B.

The characteristics of the thus obtained photosensitive recording materials were determined as described above and are summarized together with those for EXAMPLE 1 in Tables 6A and 6B. The sensitivity to monochromatic 540 nm light exposure is expressed as the % discharge at an exposure ($I_{540}t$) of 36.6 mJ/m$^2$ and the steepness of the discharge-exposure dependence is expressed as the % discharge observed between exposures ($I_{540}t$) of 3.66 mJ/m$^2$ and 11.6 mJ/m$^2$ (see Table 6A) or between exposures ($I_{540}t$) of 11.6 mJ/m$^2$ and 36.6 mJ/m$^2$ (see Table 6B) depending upon the sensitivity of the photosensitive recording material.

TABLE 5A

| | DBA conc. [wt %] | Bis-flectol conc. [wt %] | P1 conc. [wt %] | P2 conc. [wt %] | layer thickness [μm] | CL [V] | % discharge for $I_{540}t$ = 36.6 mJ/m$^2$ | % discharge between $I_{540}t$'s of 11.6 and 36.6 mJ/m$^2$ |
|---|---|---|---|---|---|---|---|---|
| Example No. | | | | | | | | |
| 37 | 25 | 40 | 31.5 | 3.5 | 13 | −624 | 68.3 | 45.0 |
| 38 | 25 | 30 | 40.5 | 4.5 | 11 | −598 | 75.9 | 53.8 |
| 39 | 25 | 10 | 58.5 | 6.5 | 17 | −916 | 95.5 | 83.6 |
| 40 | 25 | 5 | 63.0 | 7.0 | 16 | −823 | 91.6 | 85.4 |
| 41 | 25 | 3 | 64.8 | 7.2 | 17 | −844 | 91.1 | 88.0 |
| 42 | 25 | 1 | 66.6 | 7.4 | 15 | −911 | 86.2 | 83.6 |
| 43 | 25 | 0.3 | 67.23 | 7.47 | 11 | −996 | 4.8 | — |
| 44 | 25 | 0.1 | 67.41 | 7.49 | 12 | −1034 | 3.3 | — |
| 45 | 25 | 0.03 | 67.473 | 7.497 | 13 | −1012 | 1.2 | — |
| Comparative Example No. | | | | | | | | |
| 18 | 25 | 0 | 67.5 | 7.5 | 12 | −980 | 2.3 | — |
| 19 | 25 | 50 | 22.5 | 2.5 | 17 | −648 | 65.6 | 40.4 |

TABLE 5B

| | DBA conc. [wt %] | Bis-flectol conc. [wt %] | P1 conc. [wt %] | P2 conc. [wt %] | layer thickness [μm] | CL [V] | % discharge between $I_{540}t$'s of 36.6 and 116 mJ/m$^2$ | % discharge between $I_{540}t$'s of 76 and 240 mJ/m$^2$ |
|---|---|---|---|---|---|---|---|---|
| Example No. | | | | | | | | |
| 43 | 25 | 0.3 | 67.23 | 7.47 | 11 | −996 | 71.6 | 75.2 |
| 44 | 25 | 0.1 | 67.41 | 7.49 | 12 | −1034 | — | 75.5 |
| 45 | 25 | 0.03 | 67.473 | 7.497 | 13 | −1012 | — | 64.7 |
| Comparative Example No. | | | | | | | | |
| 18 | 25 | 0 | 67.5 | 7.5 | 12 | −980 | — | 30.6 |

TABLE 6A

| | DBA conc. [wt %] | Bis-flectol conc. [wt %] | P1 conc. [wt %] | P2 conc. [wt %] | layer thickness [μm] | CL [V] | % discharge for $I_{540}t$ = 36.6 mJ/m$^2$ | % discharge between $I_{540}t$'s of 3.66 and 11.6 mJ/m$^2$ |
|---|---|---|---|---|---|---|---|---|
| Example No. | | | | | | | | |
| 1 | 30 | 5 | 58.5 | 6.5 | 12 | −730 | 90.0 | — |
| 46 | 40 | 5 | 49.5 | 5.5 | 15 | −639 | 95.1 | 87.5 |
| 47 | 50 | 5 | 40.5 | 4.5 | 15 | −662 | 97.7 | 82.0 |

TABLE 6A-continued

| | DBA conc. [wt %] | Bis-flectol conc. [wt %] | P1 conc. [wt %] | P2 conc. [wt %] | layer thickness [μm] | CL [V] | % discharge for $I_{540}t$ = 36.6 mJ/m² | % discharge between $I_{540}t$'s of 3.66 and 11.6 mJ/m² |
|---|---|---|---|---|---|---|---|---|
| 48 | 60 | 5 | 31.5 | 3.5 | 16 | −654 | 97.9 | 85.0 |
| 49 | 70 | 3 | 22.5 | 2.5 | 15 | −530 | 98.1 | 73.6 |
| Comparative Example No. | | | | | | | | |
| 20 | 85 | 5 | 9.0 | 1.0 | 16 | −176 | 96.0 | 29.5 |

TABLE 6B

| Example No. | DBA conc. [wt %] | Bis-flectol conc. [wt %] | P1 conc. [wt %] | P2 conc. [wt %] | layer thickness [μm] | CL [V] | % discharge for $I_{540}t$ = 36.6 mJ/m² | % discharge between $I_{540}t$'s of 11.6 and 36.6 mJ/m² |
|---|---|---|---|---|---|---|---|---|
| 1 | 30 | 5 | 58.5 | 6.5 | 12 | −730 | 90.0 | 81.1 |

EXAMPLES 50 AND 51

The photosensitive recording materials of EXAMPLES 50 to 51 were produced as described for EXAMPLE 34 except that the concentrations of 4,10-dibromoanthanthrone were reduced to 10 and 8 wt % respectively and the concentrations of the binders were varied appropriately as given in Tables 7A and 7B. The layer thicknesses are given also in said Tables.

The characteristics of the thus obtained photosensitive recording materials were determined as described above and are summarized together with these for EXAMPLE 34 in Tables 7A and 7B. The sensitivity to monochromatic 540 nm light exposure is expressed as the % discharge at an exposure ($I_{540}t$) of 116 mJ/m² and the steepness of the discharge-exposure dependence is expressed as the % discharge observed either between exposures ($I_{540}t$) of 36.6 mJ/m² and 116 mJ/m² (see Table 7A) or between exposures ($I_{540}t$) of 11.6 mJ/m² and 36.6 J/m² (see Table 7B) depending upon the sensitivity of the photosensitive recording material.

TABLE 7A

| Example No. | DBA conc. [wt %] | Bis-flectol conc. [wt %] | P1 conc. [wt %] | P2 conc. [wt %] | layer thickness [μm] | CL [V] | % discharge for $I_{540}t$ = 116 mJ/m² | % discharge between $I_{540}t$'s of 36.6 and 116 mJ/m² |
|---|---|---|---|---|---|---|---|---|
| 34 | 25 | 10 | 58.5 | 6.5 | 14 | −835 | 96.4 | — |
| 50 | 10 | 10 | 72.0 | 8.0 | 17 | −863 | 70.5 | 56.2 |
| 51 | 8 | 10 | 73.8 | 8.2 | 12 | −725 | 83.3 | 56.8 |

TABLE 7B

| Example No. | DBA conc. [wt %] | Bis-flectol conc. [wt %] | P1 conc. [wt %] | P2 conc. [wt %] | layer thickness [μm] | CL [V] | % discharge for $I_{540}t$ = 116 mJ/m² | % discharge between $I_{540}t$'s of 11.6 and 36.6 mJ/m² |
|---|---|---|---|---|---|---|---|---|
| 34 | 25 | 10 | 58.5 | 6.5 | 14 | −835 | 96.4 | 85.3 |

EXAMPLE 52

The photosensitive recording material of EXAMPLE 52 was produced as described for EXAMPLE 7 except that N,N'-bis(4-methyl-phenyl) perylimide was used as the sensitizing pigment instead of 4,10-dibromo anthanthrone C.I. Pigment Red 168 and CI 59 300. The layer thickness was 14 μm. This photosensitive recording material exhibited 5.7% discharge upon $I_{540}t$ exposure of 36.6 mJ/m² and 89.6% discharge between $I_{540}t$ exposures of 36.6 mJ/m² and 116 mJ/m².

EXAMPLE 53

The photosensitive recording material of EXAMPLE 53 was produced as described for EXAMPLE 7 except that N,N'-bis(2,5-dimethyl-phenyl) perylimide was used as the sensitizing pigment instead of 4,10-dibromo anthanthrone C.I. Pigment Red 168 and CI 59 300. The layer thickness was 15 μm. This photosensitive recording material exhibited 4.4% discharge upon $I_{540}t$ exposure of 36.6 mJ/m² and 87.3% discharge between $I_{540}t$ exposures of 36.6 mJ/m² and 116 mJ/m².

EXAMPLE 54

The photosensitive recording material of EXAMPLE 54 was produced as described for EXAMPLE 17 except that N,N'-bis(4-cyclohexyl-phenyl) perylimide was used as the sensitizing pigment instead of 4,10-dibromo anthanthrone C.I. Pigment Red 168 and CI 59 300. The layer thickness was 15 μm. This photosensitive recording material exhibited 3.8% discharge upon $I_{575}t$ exposure of 53.8 mJ/m² and 54.7% discharge between $I_{575}t$ exposures of 53.8 mJ/m² and 170 mJ/m².

EXAMPLE 55

The photosensitive recording material of EXAMPLE 55 was produced as described for EXAMPLE 7 except that N,N'-bis(3-methyl-phenyl) perylimide was used as the sensitizing pigment instead of 4,10-dibromo anthanthrone C.I. Pigment Red 168 and CI 59 300. The layer thickness was 13 μm. This photosensitive recording material exhibited 6.9% discharge upon $I_{575}t$ exposure of 53.8 mJ/m² and 55.6% discharge between $I_{575}t$ exposures of 53.8 mJ/m² and 170 mJ/m².

EXAMPLE 56

The photosensitive recording material of EXAMPLE 56 was produced as described for EXAMPLE 17 except that N,N'-bis(2,3,5-trimethyl-phenyl) perylimide was used as the sensitizing pigment instead of 4,10-dibromo anthanthrone C.I. Pigment Red 168 and CI 59 300. The layer thickness was 15 μm. This photosensitive recording material exhibited 1.2% discharge upon $I_{540}t$ exposure of 36.6 mJ/m² and 71.8% discharge between $I_{540}t$ exposures of 36.6 mJ/m² and 116 mJ/m².

EXAMPLE 57

The photosensitive recording material of EXAMPLE 57 was produced by first doctor blade coating a 100 μm thick polyester film precoated with a vacuum-deposited conductive layer of aluminium with a 1% solution of γ-aminopropyltriethoxy silane in aqueous methanol. After evaporating the solvent and curing the resulting adhesion/blocking layer at 100° C. for 30 minutes, the adhesion/blocking layer was overcoated with a dispersion of charge generating pigment containing charge transport material to a thickness of 16 μm.

Said dispersion was prepared by mixing 2 g of 4,10-dibromo-anthanthrone, 0.78 g of aromatic polycarbonate MAKROLON CD 2000 (registered trade mark) and 20.38 g of dichloromethane for 15 minutes in a pearl mill. 0.8 g of α,α'bis (6-ethoxy-1,2-dihydro-2,2,4-trimethyl-quinolin-1-yl)-p-xylene, 4.42 g of MAKROLON CD 2000 (registered trade mark) and 11.6 g of dichloromethane were then added and the resulting mixture mixed for a further 5 minutes to produce the composition and viscosity for casting.

The photosensitive layer was then dried for 16 hours at 50° C.

The characteristics of the thus obtained photosensitive recording material ware determined as described above. The sensitivity to monochromatic 540 nm light exposure is expressed as the % discharge at an exposure ($I_{540}t$) of 38 mJ/m² and the steepness of the discharge-exposure dependence is expressed as the % discharge observed between exposures ($I_{540}t$) of 12 mJ/m² and 38 mJ/m², a factor of 3.16 difference in exposure:

% discharge for $I_{540}t$=38 mJ/m²: 89.2

% discharge between $I_{540}t$'s of 12 mJ/m² and 38 mJ/m²: 72.4.

EXAMPLES 58 TO 61 AND COMPARATIVE EXAMPLE 21

In the production of EXAMPLES 58 to 61 and COMPARATIVE EXAMPLE 21 a 100 μm thick polyester film precoated with a vacuum-deposited conductive layer of aluminium was doctor-blade coated with a dispersion of charge generating pigment containing charge transport material to thicknesses given in Table 8.

Said dispersion was prepared by mixing for 15 minutes in a pearl mill 2.5 g of 4,10-dibromoanthanthrone, 5.85 g of an aromatic polycarbonate MAKROLON CD 2000 (registered trade mark) (P1), 0.65 g of a polyester adhesion promoting additive DYNAPOL L206 (registered trade mark (P2) and 35.45 g of dichloromethane and subsequently adding 1.0 g of a mixture of 1,2-bis(1,2-dihydro-2,2,4-trimethyl-quinolin-1-yl)ethane (Bisflectol) and tris(p-tolyl)amine (TTA) in the proportions given in Table 8 and mixing for a further 5 minutes.

The resulting layer was dried for 16 hours at 50° C.

The half-wave oxidation potentials versus s.c.e. of Bisflectol and TTA determined as described above were 0.694 V and 0.772 V respectively, a difference of 0.078 V.

The characteristics of the thus obtained photosensitive recording materials were determined as described above. The sensitivity to monochromatic 540 nm light exposure is expressed as the % discharge at an exposure ($I_{540}t$) of 38 mJ/m² and the steepness of the discharge-exposure dependence is expressed as the % discharge observed between exposures ($I_{540}t$) of 12 mJ/m² and 38 mJ/m², a factor of 3.16 difference in exposure. The results are summarized in Table 8.

Sensitometric measurements were carried out using the refined sensitometric measurement techniques described above. The resulting sensitometric curves for the photosensitive layers of EXAMPLES 58, 59, 60 and 61 and COMPARATIVE EXAMPLE 21 are shown in FIGS. 6, 7, 8, 9 and 10 respectively. The exposures required for 10% and 90% discharges differ by factors of 2.8, 2.7, 2.7, 2.5 and >3.8 for the photosensitive layers of EXAMPLE 58, EXAMPLE 59, EXAMPLE 60, EXAMPLE 61, and COMPARATIVE EXAMPLE 21 respectively.

TABLE 8

| | DBA conc. [wt %] | Bis-flectol conc. [wt %] | TTA conc. [wt %] | P1 conc. [wt %] | P2 conc. [wt %] | layer thickness [μm] | CL [V] | % discharge for $I_{540}t$ = 38 mJ/m² | % discharge between $I_{540}t$'s of 12 and 38 mJ/m² |
|---|---|---|---|---|---|---|---|---|---|
| Example No. | | | | | | | | | |
| 58 | 25 | 10 | 0 | 58.5 | 6.5 | 14 | −671 | 94.3 | 80.8 |
| 59 | 25 | 8 | 2 | 58.5 | 6.5 | 14 | −662 | 95.5 | 79.3 |
| 60 | 25 | 5 | 5 | 58.5 | 6.5 | 17 | −707 | 93.5 | 76.9 |
| 61 | 25 | 2 | 8 | 58.5 | 6.5 | 13 | −689 | 94.2 | 82.4 |
| COMPARATIVE EXAMPLE No. | | | | | | | | | |
| 21 | 25 | 0 | 10 | 58.5 | 6.5 | 14 | −711 | 67.5 | 55.7 |

EXAMPLES 62 and 63 and COMPARATIVE EXAMPLE 22

The photosensitive recording materials of EXAMPLES 62 and 63 and COMPARATIVE EXAMPLE 22 were produced as described for EXAMPLES 58 to 61 and COMPARATIVE EXAMPLE 21 except that 2,5-bis(4-N,N-diethylaminophenyl)oxidazole-1,3,4 (OXA) was substituted for tris(p-tolyl)amine. The compositions and layer thickness of the resulting photosensitive recording materials are given in TABLE 9.

The half-wave oxidation potentials versus s.c.e. of Bisflectol and OXA determined as described above were 0.694 V and 0.87 V respectively, a difference of 0.176 V.

The characteristics of the thus obtained photosensitive recording materials were determined as described above. The sensitivity to monochromatic 540 nm light exposure is expressed as the % discharge at an exposure ($I_{540}t$) of 38 mJ/m$^2$ and the steepness of the discharge exposure dependence is expressed as the % discharge observed between exposures ($I_{540}t$) of 12 mJ/m$^2$ and 38 mJ/m$^2$ a factor of 3.16 difference in exposure. The results are summarized together with those for EXAMPLE 58 in TABLE 9 below.

Figure 11:
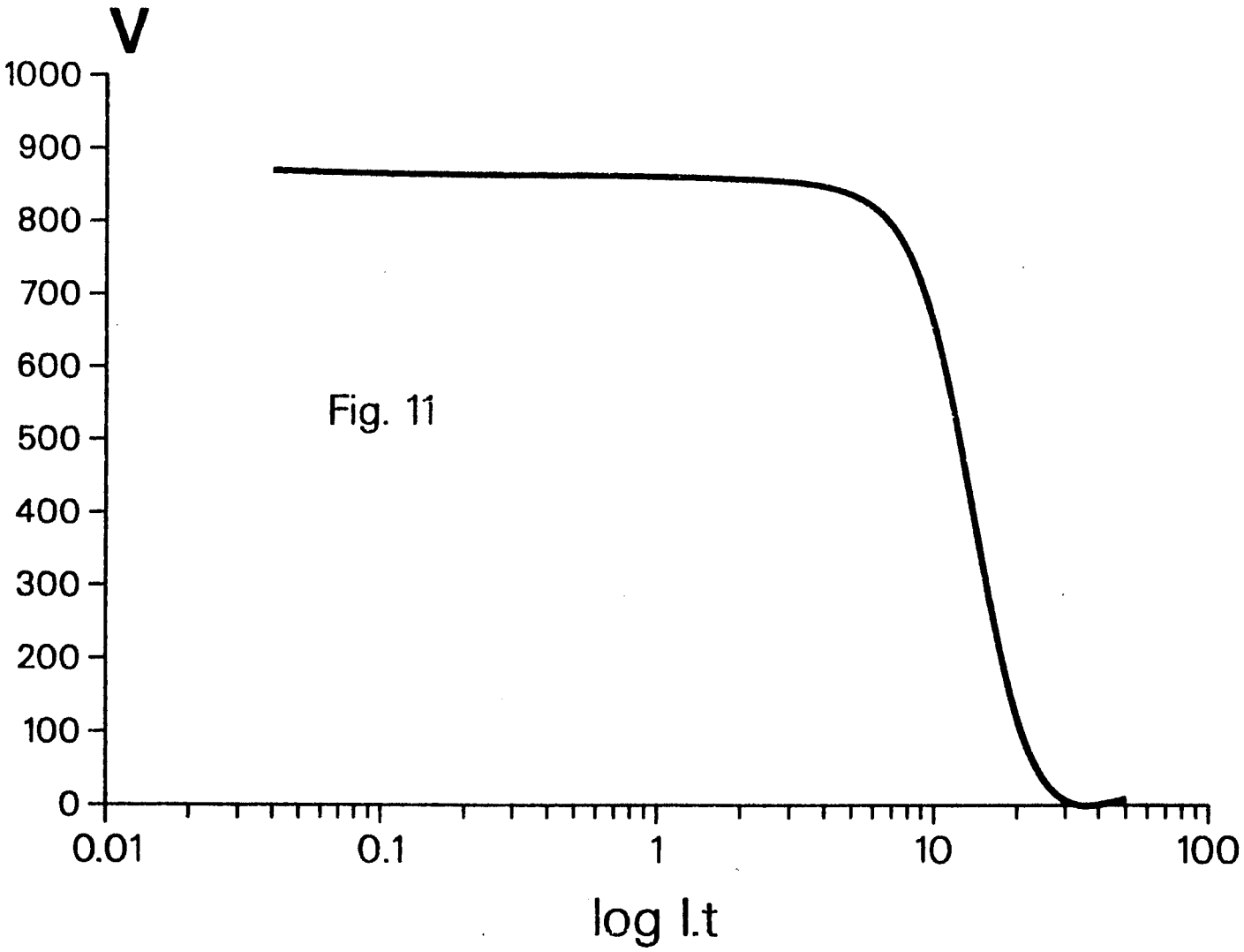
Figure 12:
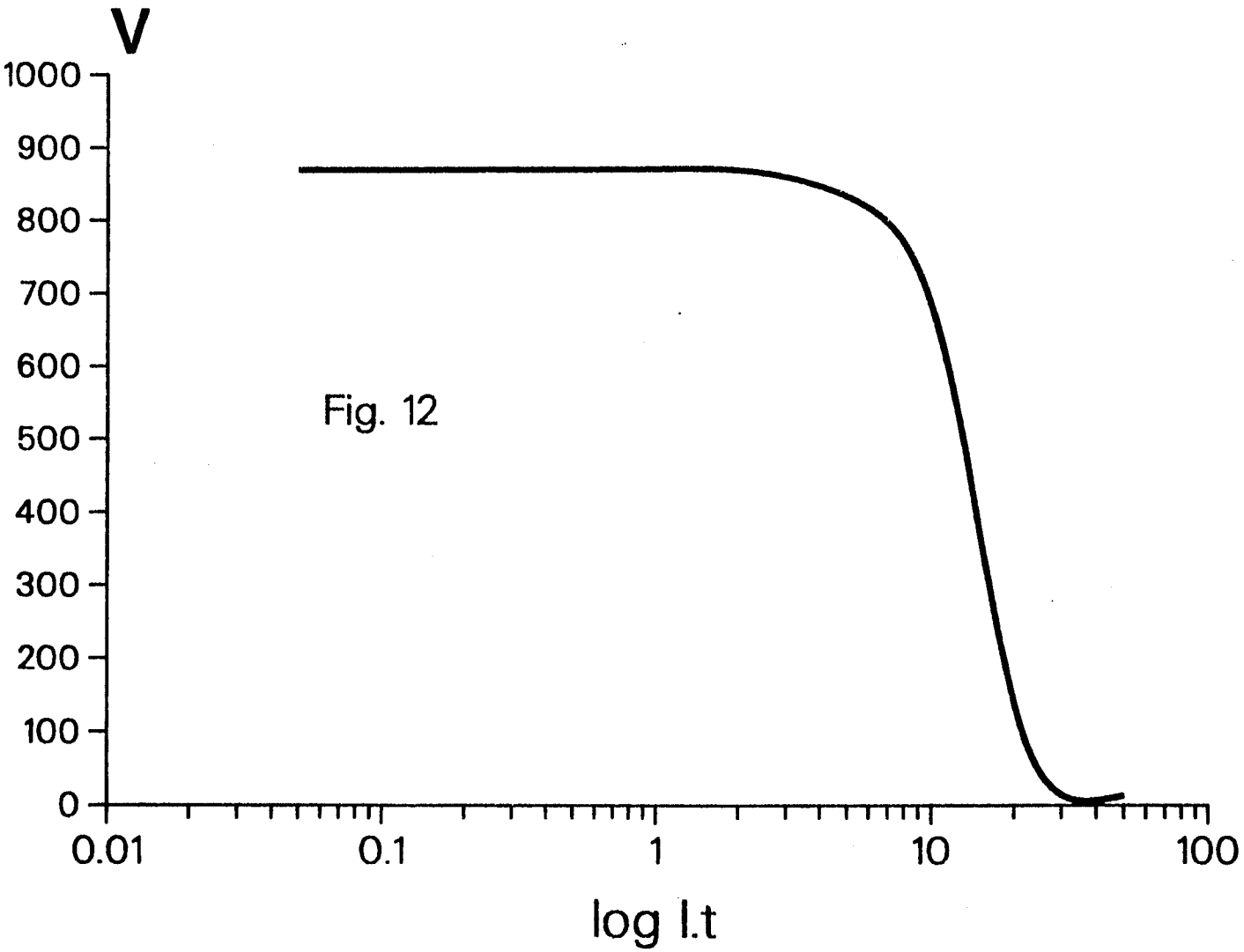
Figure 13:
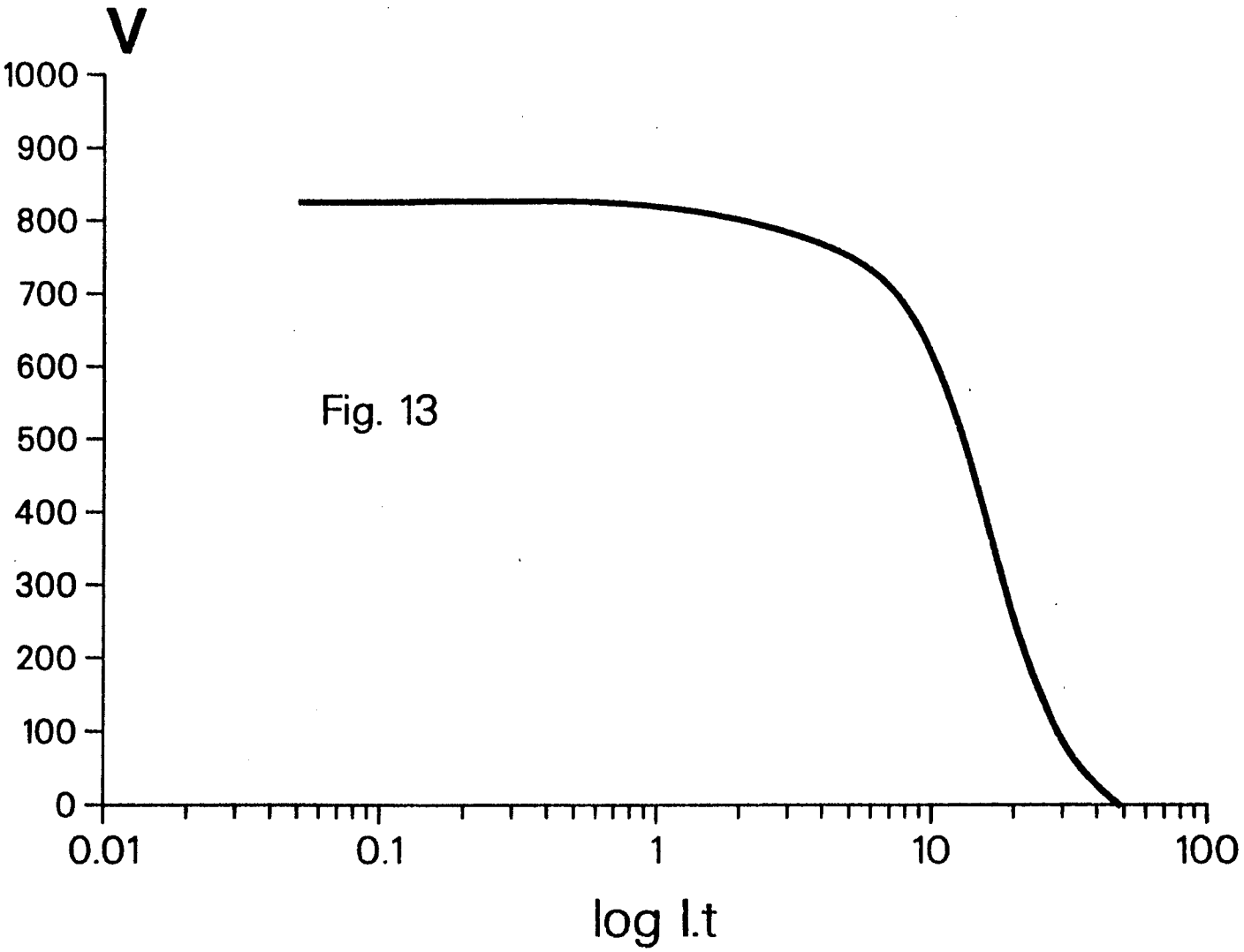

Sensitometric measurements were carried out using the refined sensitometric measurement techniques described above. The resulting sensitometric curves for the photosensitive layers of EXAMPLES 62 and 63 and COMPARATIVE EXAMPLE 22 are shown in FIGS. 11, 12 and 13. The exposures required for 10% and 90% discharge differ by factors of 2.6 and 2.5 for EXAMPLE 62 and EXAMPLE 63 respectively compared with 2.8 for EXAMPLE 58 (FIG. 6), and 4.7 for COMPARATIVE EXAMPLE 22.

TABLE 9

| | DBA conc. [wt %] | Bis-flectol conc. [wt %] | OXA conc. [wt %] | P1 conc. [wt %] | P2 conc. [wt %] | layer thickness [μm] | CL [V] | % discharge for $I_{540}t$ = 38 mJ/m$^2$ | % discharge between $I_{540}t$'s of 12 and 38 mJ/m$^2$ |
|---|---|---|---|---|---|---|---|---|---|
| Example No. | | | | | | | | | |
| 58 | 25 | 10 | 0 | 58.5 | 6.5 | 14 | −671 | 94.3 | 90.8 |
| 62 | 25 | 5 | 5 | 58.5 | 6.5 | 16 | −586 | 95.9 | 58.5 |
| 63 | 25 | 2 | 8 | 58.5 | 6.5 | 14 | −657 | 96.5 | 57.7 |
| COMPARATIVE EXAMPLE No. | | | | | | | | | |
| 22 | 25 | 0 | 10 | 58.5 | 6.5 | 10 | −627 | 97.0 | 68.6 |

EXAMPLE 64

The photosensitive recording material of EXAMPLE 64 was produced as described for EXAMPLES 58 to 61 and COMPARATIVE EXAMPLE 21 except that 4-N,N-diethylaminobenzaldehyde-1',1'-diphenylhydrazone (DEH) was substituted for tris(p-tolyl)amine. The compositions and layer thickness of the resulting photosensitive recording materials are given in TABLE 10.

The half-wave oxidation potentials versus s.c.e. of Bisflectol and DEH determined as described above were 0.694 V and 0.538 V respectively, a difference of 0.156 V.

The characteristics of the thus obtained photosensitive recording material were determined as described above. The sensitivity to monochromatic 540 nm light exposure is expressed as the % discharge at an exposure ($I_{540}t$) of 38 mJ/m$^2$ and the steepness of the discharge-exposure dependence is expressed as the % discharge observed between exposures ($I_{540}t$) of 12 mJ/m$^2$ and 38 mJ/m$^2$ a factor of 3.16 difference in exposure. The results are summarized together with those for EXAMPLE 58 in TABLE 10.

Figure 6:
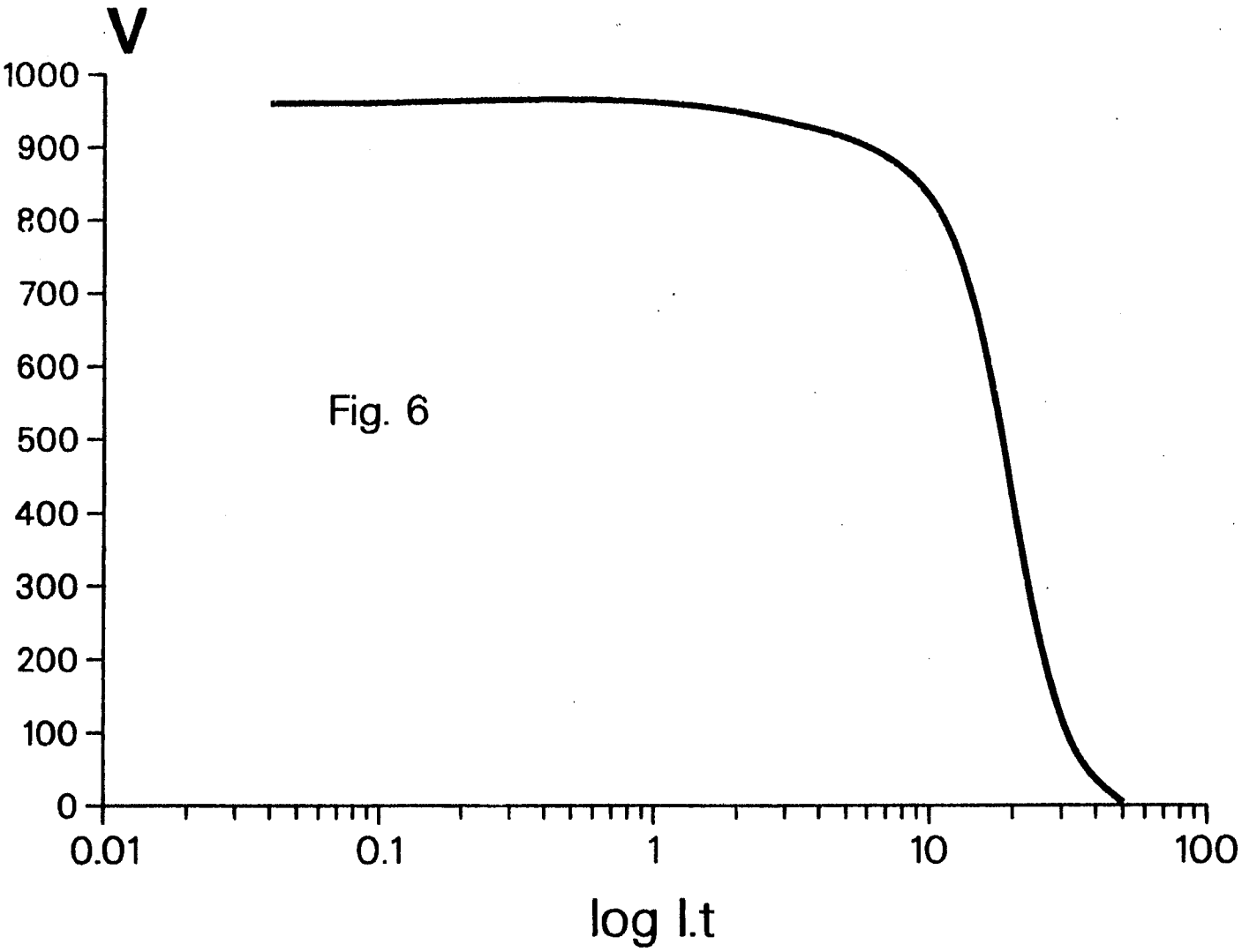
Figure 7:
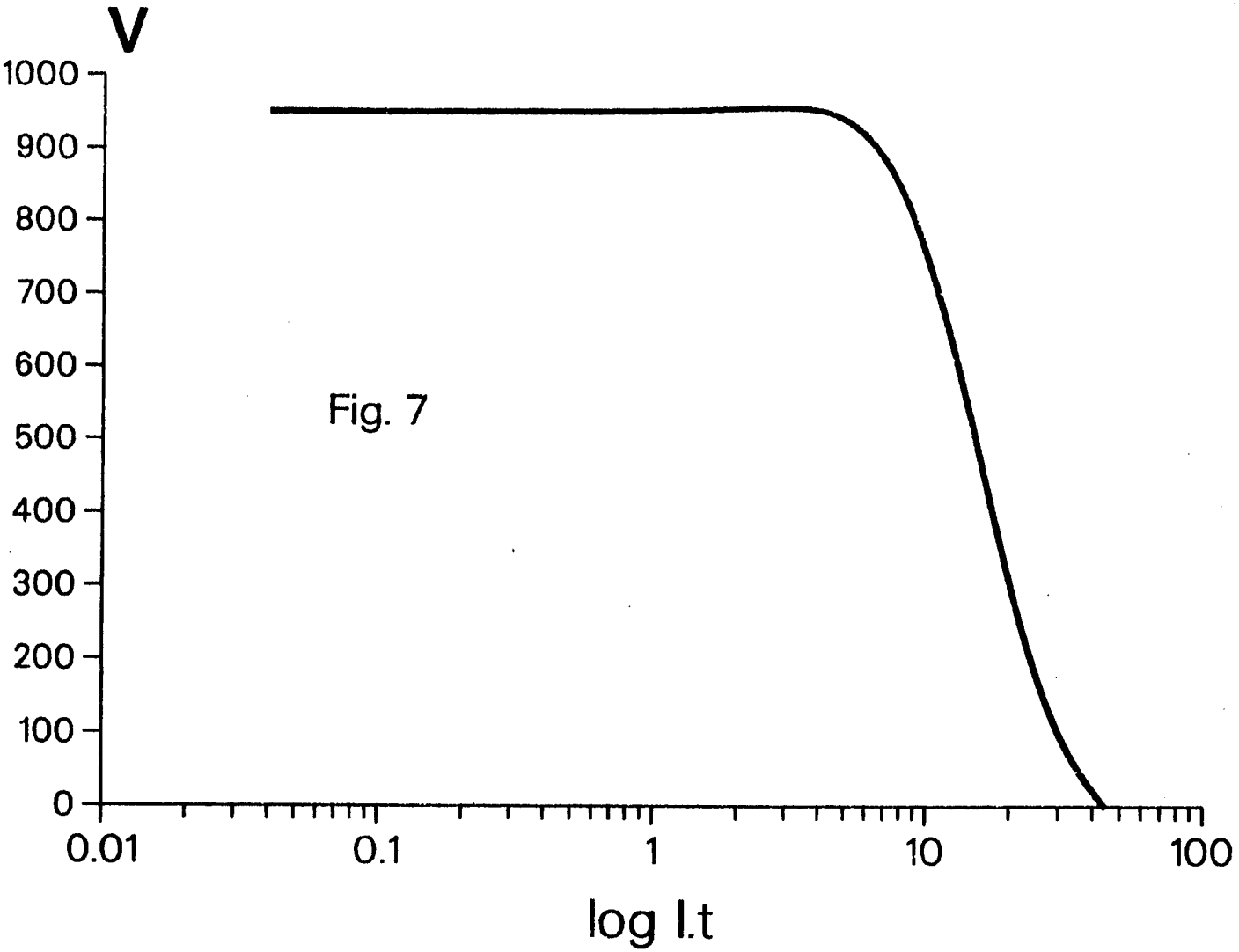
Figure 8:
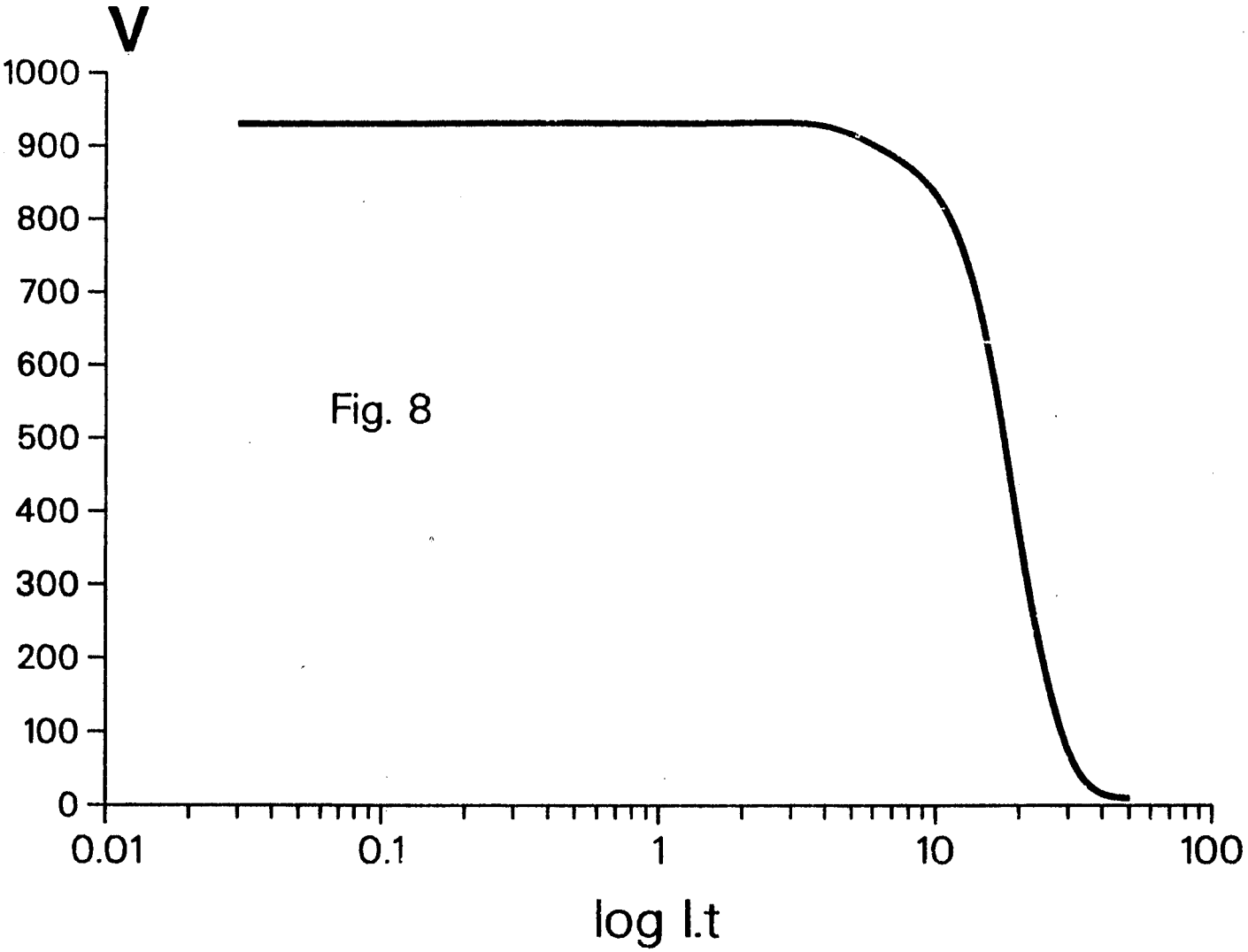
Figure 9:
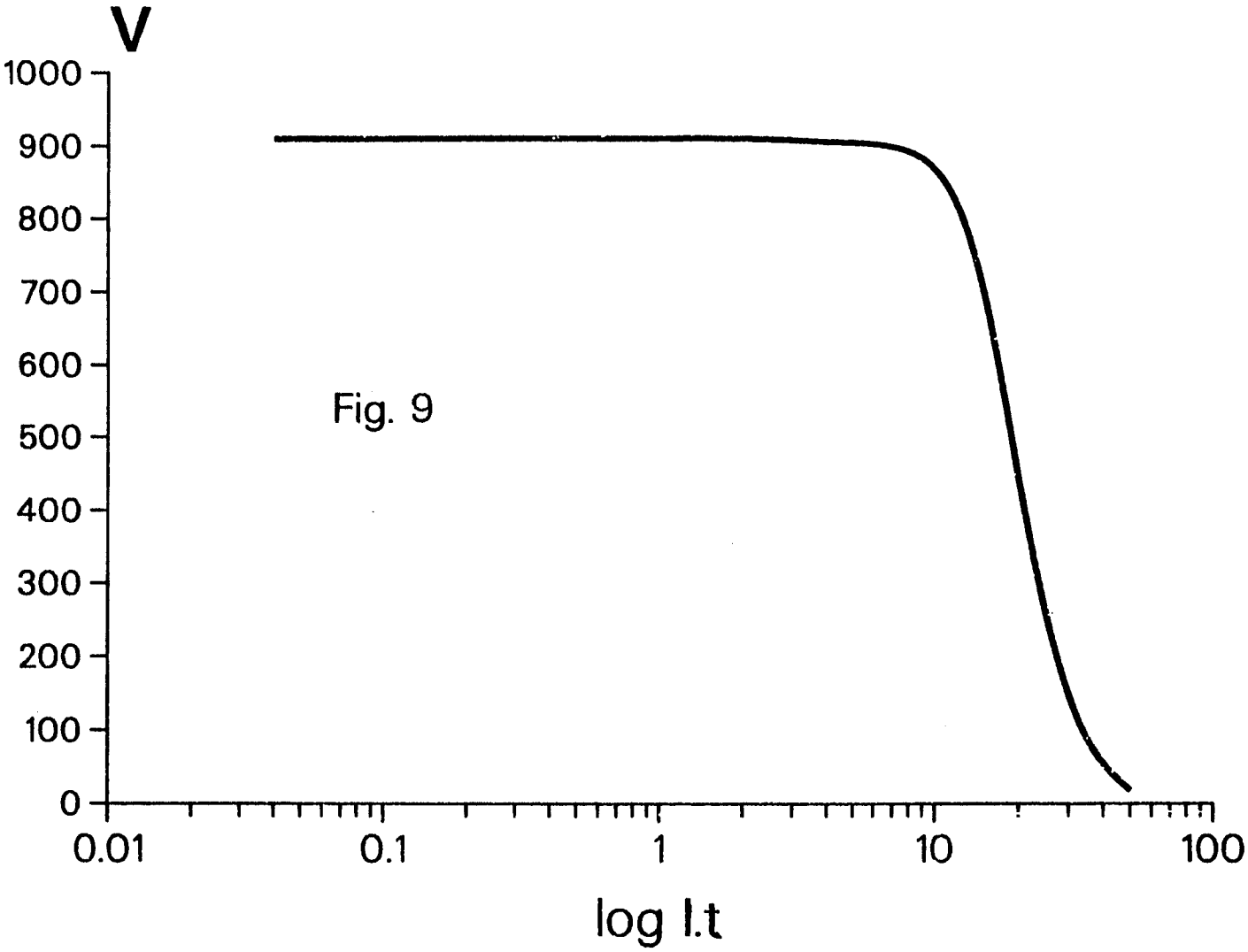
Figure 10:
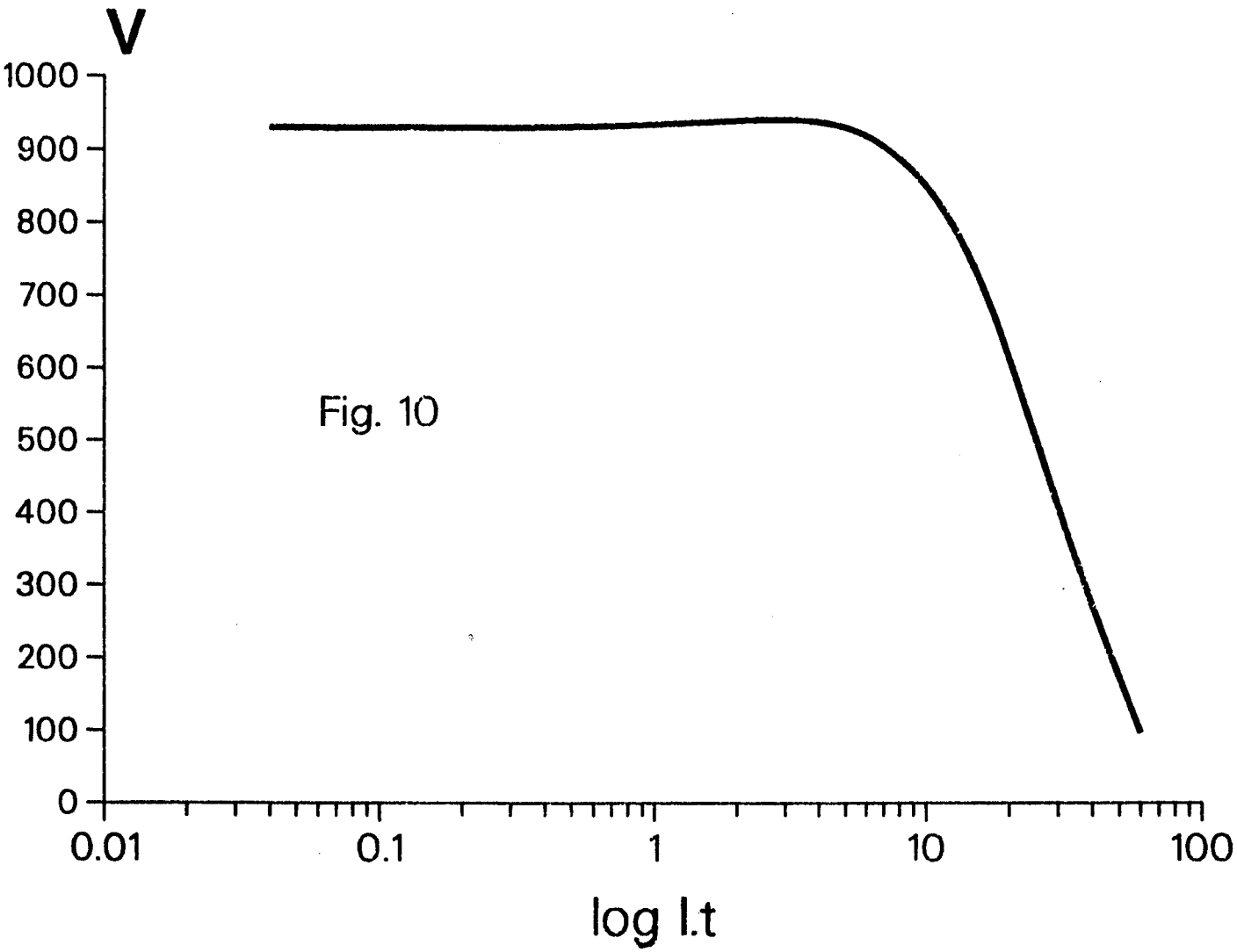
Figure 14:
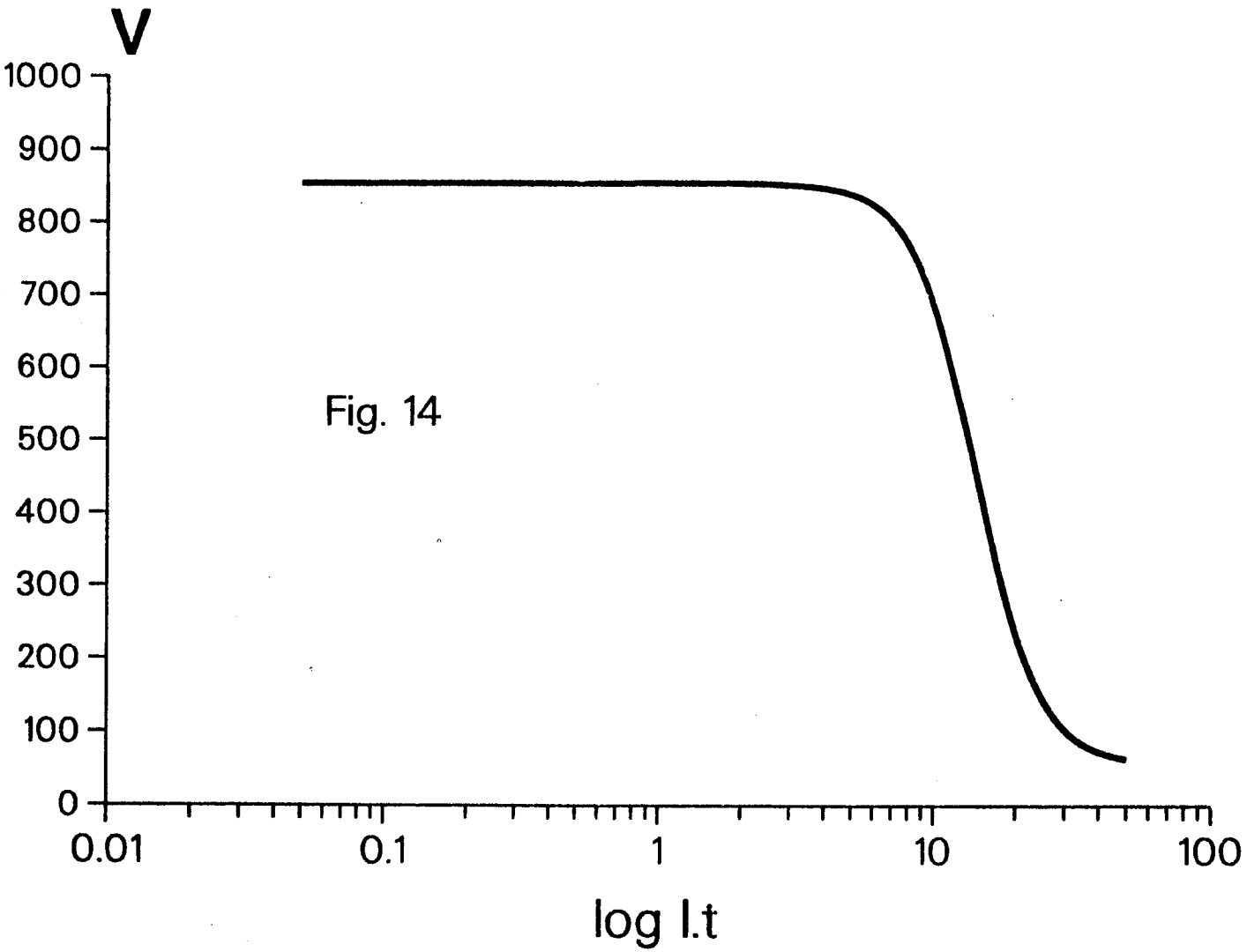
Figure 15:
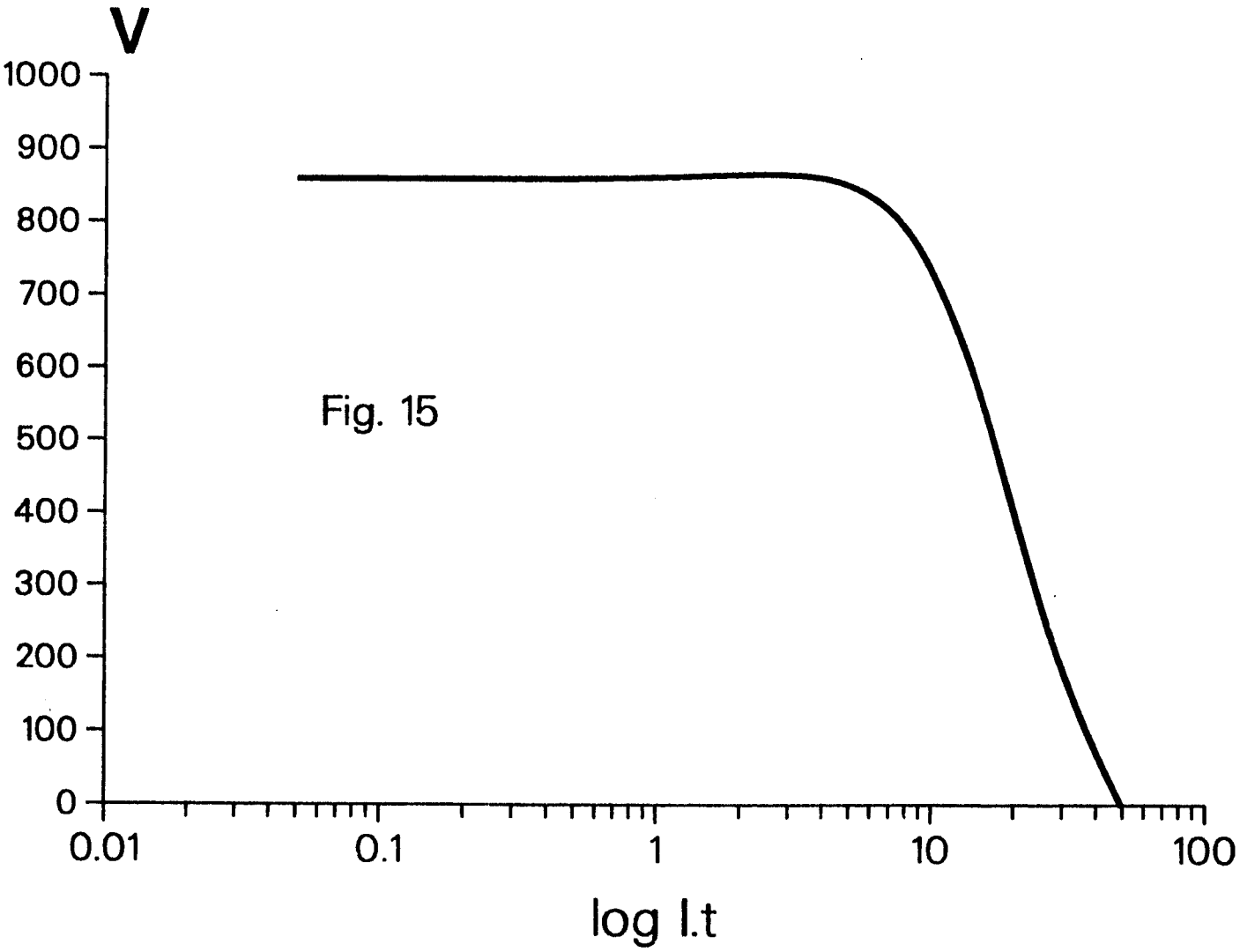
Figure 16:
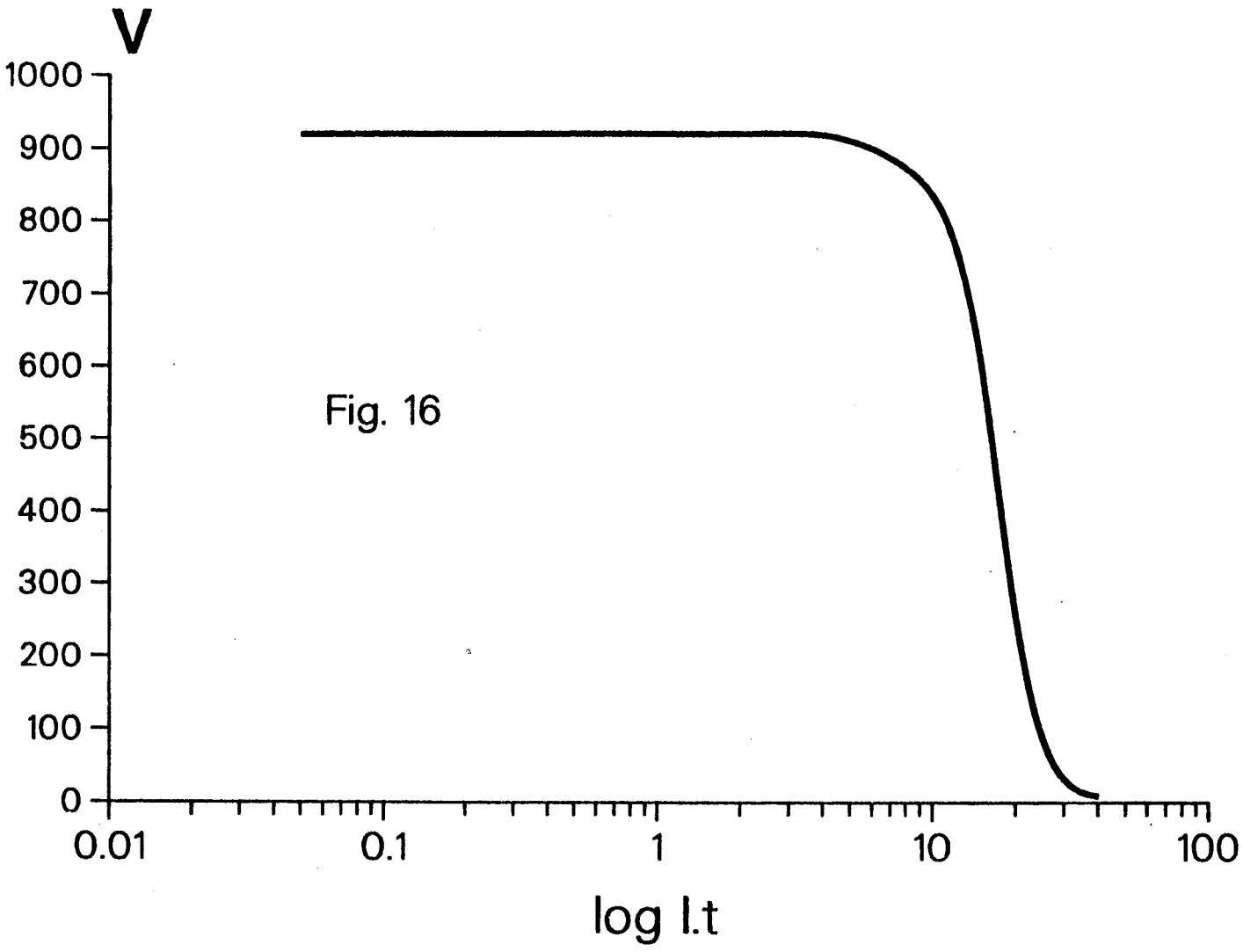

Sensitometric measurements were carried out using the refined sensitometric measurement techniques described above. The resulting sensitometric curve for the photosensitive layer of EXAMPLE 64 is shown in FIG. 14. The exposures required for 10% and 90% discharge differ by a factor of 4.3 compared with 2.8 for EXAMPLE 58 (FIG. 6).

TABLE 10

| Example No. | DBA conc. [wt %] | Bis-flectol conc. [wt %] | DEH conc. [wt %] | P1 conc. [wt %] | P2 conc. [wt %] | layer thickness [μm] | CL [V] | % discharge for $I_{540}t$ = 38 mJ/m$^2$ | % discharge between $I_{540}t$'s of 12 and 38 mJ/m$^2$ |
|---|---|---|---|---|---|---|---|---|---|
| 58 | 25 | 10 | 0 | 58.5 | 6.5 | 14 | −671 | 94.3 | 80.8 |
| 64 | 25 | 5 | 5 | 58.5 | 6.5 | 13 | −691 | 91.9 | 62.1 |

EXAMPLE 65

The photosensitive recording material of EXAMPLE 65 was produced as described for EXAMPLE 60 except that 1,2-bis(1,2-dihydro-2,2,4,6,7-pentamethylquinolin-1-yl)ethane (DH) was substituted for tris(p-tolyl)amine and the layer thickness was 10 μm instead of 17 μm.

The half-wave oxidation potentials versus s.c.e. of Bisflectol and DH determined as described above were 0.694 V and 0.595 V respectively, corresponding to a difference of 0.099 V.

The characteristics of the thus obtained photosensitive recording materials were determined as described above. The sensitivity to monochromatic 540 nm light exposure is expressed as the % discharge at an exposure ($I_{540}t$) of 38 mJ/m$^2$ and the steepness of the discharge-exposure dependence is expressed as the % discharge observed between exposures ($I_{540}t$) of 12 mJ/m$^2$ and 38 mJ/m$^2$ a factor of 3.16 difference in exposure. The results are summarized together with those example 58 in TABLE 11 below.

Sensitometric measurements were carried out using the refined sensitometric measurement techniques described above. The resulting sensitometric curve for the photosensitive layer of EXAMPLES 65 shown in FIG. 15. The exposures required for 10% and 90% discharge differ by a factor of 4.0.

TABLE 11

| Example No. | DBA conc. [wt %] | Bis-flectol conc. [wt %] | DH conc. [wt %] | P1 conc. [wt %] | P2 conc. [wt %] | layer thickness [μm] | CL [V] | % discharge for $I_{540}t$ = 38 mJ/m² | % discharge between $I_{540}t$'s of 12 and 38 mJ/m² |
|---|---|---|---|---|---|---|---|---|---|
| 58 | 25 | 10 | 0 | 58.5 | 6.5 | 14 | −671 | 94.3 | 80.8 |
| 65 | 25 | 5 | 5 | 58.5 | 6.5 | 10 | −488 | 92.8 | 80.5 |

COMPARATIVE EXAMPLE 23

The photosensitive material of COMPARATIVE EXAMPLE 23 was produced as described for EXAMPLE 7 exept that the charge transport material N(4-N,N-dibenzylphenyl)-carbazole (DPPC) was used instead of Bisflectol and the layer thickness was 14 μm instead of 10 μm.

The characteristics of the thus obtained photosensitive recording materials were determined as described above. The sensitivity to monochromatic 540 nm light exposure is expressed as the % discharge at an exposure ($I_{540}t$) of 36.6 mJ/m² and the steepness of the discharge-exposure dependence is expressed as the % discharge observed between exposures ($I_{540}t$) of 11.6 mJ/m² and 36.6 mJ/m² a factor of 3.16 difference in exposure. The residual potential for an exposure ($I_{540}t$) of 116 mJ/m² − 104 V was greater than 10% of the charging level: −892 V indicating that the exposures required for 10% and 90% discharge differ by a factor > 10.

EXAMPLE 66

The photosensitive recording material of EXAMPLE 66 was produced as described for EXAMPLE 60 except that DPPC was substituted for TTA and the layer thickness was 14 μm instead of 17 μm.

The half-wave oxidation potentials versus s.c.e. of Bisflectol and DPPC determined as described above were 0.694 and 0.915 V respectively, corresponding to a difference of 0.221 V.

The characteristics of the thus obtained photosensitive recording materials were determined as described above. The sensitivity to monochromatic 540 nm light exposure is expressed as the % discharge at an exposure ($I_{540}t$) of 38 mJ/m² and the steepness of the discharge-exposure dependence is expressed as the % discharge observed between exposures ($I_{540}t$) of 12 mJ/m² and 38 mJ/m² a factor of 3.16 difference in exposure. The results are summarized together with those for EXAMPLE 58 and COMPARATIVE EXAMPLE 23 in TABLE 12 below.

Sensitometric measurements were carried out using the refined sensitometric measurement techniques described above. The resulting sensitometric curve for the photosensitive layers of EXAMPLE 66 shown in FIG. 16. The exposures required for 10% and 90% discharge differ by a factor of 2.2.

TABLE 12

| | DBA conc. [wt %] | Bis-flectol conc. [wt %] | DPPC conc. [wt %] | P1 conc. [wt %] | P2 conc. [wt %] | layer thickness [μm] | CL [V] | % discharge for $I_{540}t$ = 38 mJ/m² | % discharge between $I_{540}t$'s of 12 and 38 mJ/m² |
|---|---|---|---|---|---|---|---|---|---|
| Example No. | | | | | | | | | |
| 58 | 25 | 10 | 0 | 58.5 | 6.5 | 14 | −671 | 94.3 | 80.8 |
| 66 | 25 | 5 | 5 | 58.5 | 6.5 | 14 | −554 | 94.2 | 81.4 |
| COMPARATIVE EXAMPLE No. | | | | | | | | | |
| 23 | 25 | 0 | 10 | 58.5 | 6.5 | 14 | −892 | 82.1 | 72.3 |

EXAMPLE 67

The photosensitive recording material of EXAMPLE 67 was produced as described for EXAMPLE 60 except that α,α'-bis(6-ethoxy-1,2-dihydro-2,2,4-trimethyl quinolin-1-yl) p-xylene (EQX) and OXA have been substituted for Bisflectol and TTA and that the layer thickness layer of the photosensitive recording material was 16 μm instead of 17 μm.

The half-wave oxidation potentials versus s.c.e. of EQX and OXA determined as described above were 0.540 V and 0.870 V respectively, a difference of 0.330 V.

The characteristics of the thus obtained photosensitive recording materials were determined as described above. The sensitivity to monochromatic 540 nm light exposure is expressed as the % discharge at an exposure ($I_{540}t$) of 38 mJ/m² and the steepness of the discharge-exposure dependence is expressed as the % discharge observed between exposures ($I_{540}t$) of 12 mJ/m² and 38 mJ/m² a factor of 3.16 difference in exposure. The results are summarize together with those for EXAMPLE 57 and comparative EXAMPLE 22 in TABLE 13.

Figure 17:
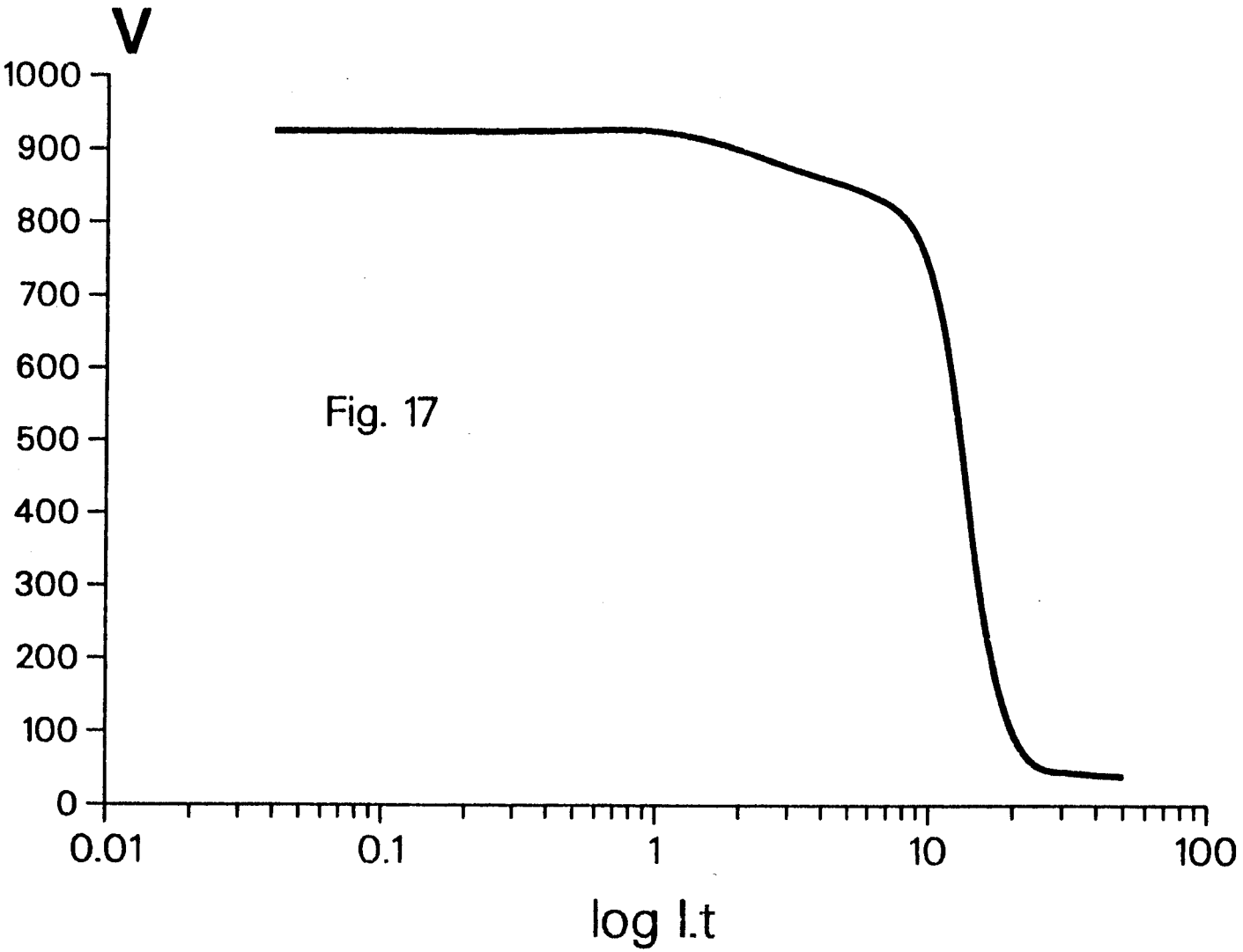
Figure 18:
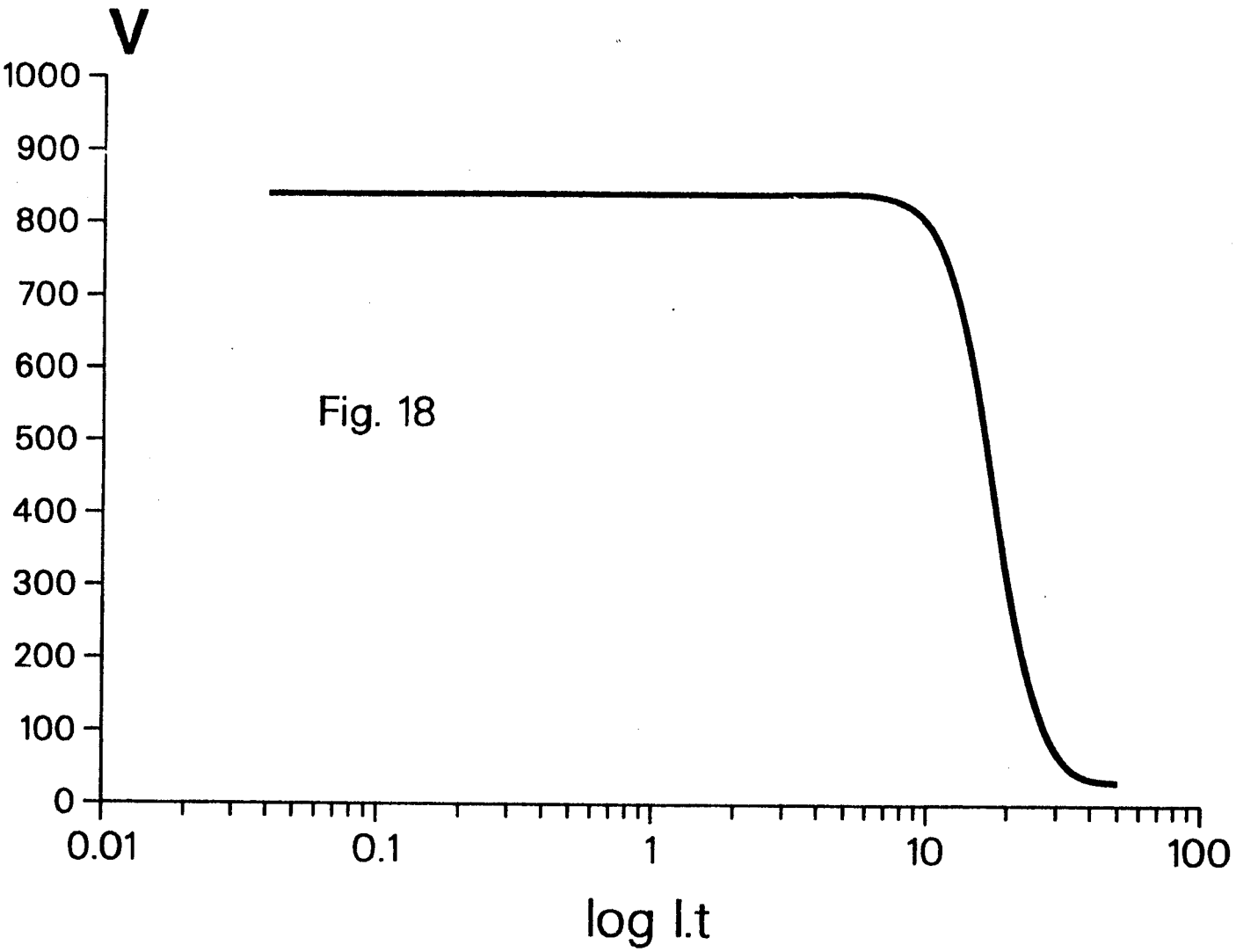
Figure 19:
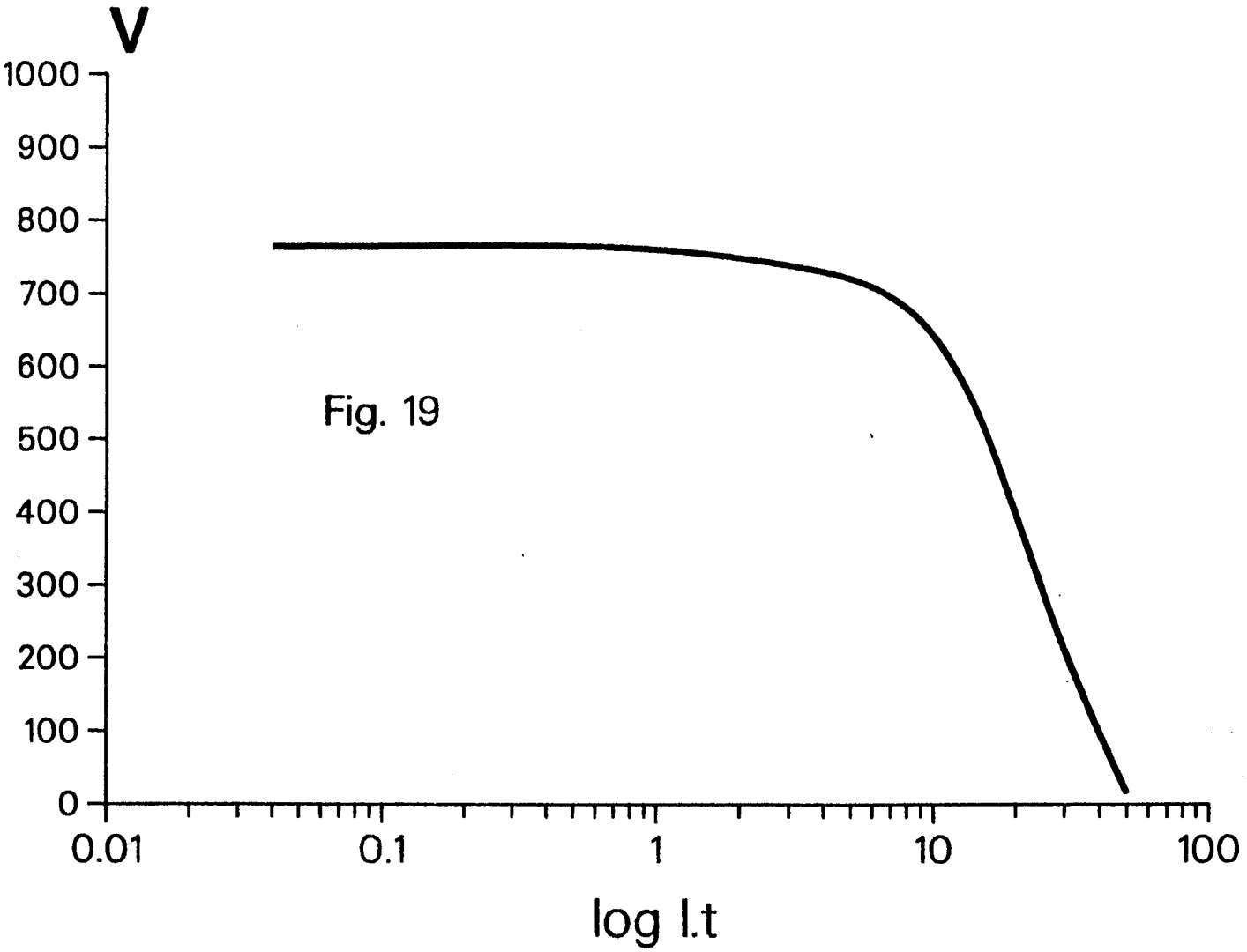

Sensometric measurements were carried out using the refind sensitometric measurement techniques described above. The resulting sensitometric curve for the photosensitive layer of EXAMPLE 67 is shown in FIG. 17. The exposures required for 10% and 90% discharge differ by a factor of 2.7.

TABLE 13

| | DBA conc. [wt %] | EQX conc. [wt %] | OXA conc. [wt %] | P1 conc. [wt %] | P2 conc. [wt %] | layer thickness [μm] | CL [V] | % discharge for $I_{540}t$ = 38 mJ/m² | % discharge between $I_{540}t$'s of 12 and 38 mJ/m² |
|---|---|---|---|---|---|---|---|---|---|
| Example No. | | | | | | | | | |
| 57 | 25 | 10 | 0 | 58.5 | 6.5 | 16 | −845 | 89.2 | 72.4 |

TABLE 13-continued

| | DBA conc. [wt %] | EQX conc. [wt %] | OXA conc. [wt %] | P1 conc. [wt %] | P2 conc. [wt %] | layer thickness [μm] | CL [V] | % discharge for $I_{540}t$ = 38 mJ/m² | % discharge between $I_{540}t$'s of 12 and 38 mJ/m² |
|---|---|---|---|---|---|---|---|---|---|
| 67 | 25 | 5 | 5 | 58.5 | 6.5 | 16 | −267 | 82.0 | 34.1 |
| COMPARATIVE EXAMPLE No. | | | | | | | | | |
| 22 | 25 | 0 | 10 | 58.5 | 6.5 | 10 | −627 | 97.0 | 68.6 |

EXAMPLE 68

The photosensitive recording material of EXAMPLE 68 was produced as described for EXAMPLE 67 exept that DEH was substituted for OXA and the layer thickness was 13 μm instead of 16 μm.

The half-wave oxidation potentials versus s.c.e. of EQX and DEH determined as described above were 0.540 V and 0.538 V respectively a difference of 0.002 V.

The characteristics of the thus obtained photosensitive recording materials were determined as described above. The sensitivity to monochromatic 540 nm light exposure is expressed as the % discharge at an exposure ($I_{540}t$) of 38 mJ/m² and the steepness of the discharge-exposure dependence is expressed as the % discharge observed between exposures ($I_{540}t$) of 12 mJ/m² and 38 mJ/m² a factor of 3.16 difference in exposure. The results are summarized together with those EXAMPLE 57 in TABLE 9 below.

Sensitometric measurements were carried out using the refined sensitometric measurement techniques described above. The resulting sensitometric curve for the photosensitive layer of EXAMPLE 68 shown in FIG. 18. The exposures required for 10% and 90% discharge differ by a factor of 2.16.

TABLE 14

| Example No. | DBA conc. [wt %] | EQX conc. [wt %] | DEH conc. [wt %] | P1 conc. [wt %] | P2 conc. [wt %] | layer thickness [μm] | CL [V] | % discharge for $I_{540}t$ = 38 mJ/m² | % discharge between $I_{540}t$'s of 12 and 38 mJ/m² |
|---|---|---|---|---|---|---|---|---|---|
| 57 | 25 | 10 | 0 | 58.5 | 6.5 | 16 | −845 | 89.2 | 72.4 |
| 68 | 25 | 5 | 5 | 58.5 | 6.5 | 13 | −665 | 94.4 | 78.8 |

EXAMPLE 69

The photosensitive recording material of EXAMPLE 69 was produced as described for EXAMPLE 67 except that 1,2-bis-(1,2-dihydro-2,2,4,6,7-pentamethylquinolin-1-yl)ethane (DH) had been substituted for OXA and the layer thickness was 10 μm instead of 16 μm.

The half-wave oxidation potentials versus s.c.e. of EQX and 1,2-bis(1,2-dihydro-2,2,4,6,7-pentamethylquinolin-1-yl)-ethane determined as described aboven were 0.540 V and 0.595 V respectively, corresponding with a difference of 0.055 V.

The characteristics of the thus obtained photosensitive recording materials were determined as described above. The sensitivity to monochromatic 540 nm light exposure is expressed as the % discharge at an exposure ($I_{540}t$) of 38 mJ/m² and the steepness of the discharge-exposure dependence is expressed as the % discharge observed between exposures ($I_{540}t$) of 12 mJ/m² and 38 mJ/m² a factor of 3.16 difference in exposure. The results are summarized together with those EXAMPLE 57 in TABLE 15 below.

Sensitometric measurements were carried out using the refined sensitometric measurement techniques described above. The resulting sensitometric curve for the photosensitive layer of EXAMPLE 69 shown in FIG. 19. The exposures required for 10% and 90% discharge differ by a factor of 4.4

TABLE 15

| Example No. | DBA conc. [wt %] | EQX conc. [wt %] | DH conc. [wt %] | P1 conc. [wt %] | P2 conc. [wt %] | layer thickness [μm] | CL [V] | % discharge for $I_{540}t$ = 38 mJ/m² | % discharge between $I_{540}t$'s of 12 and 38 mJ/m² |
|---|---|---|---|---|---|---|---|---|---|
| 57 | 25 | 10 | 0 | 58.5 | 6.5 | 16 | −845 | 89.2 | 72.4 |
| 69 | 25 | 5 | 5 | 58.5 | 6.5 | 10 | −455 | 90.5 | 76.3 |

EXAMPLE 70 AND COMPARATIVE EXAMPLE 24

The photosensitive recording materials of EXAMPLE 70 and COMPARATIVE EXAMPLE 24 were produced as described for EXAMPLE 60 and COMPARATIVE EXAMPLE 21 respectively except that 1,3,5-tris[4-N,N-bis(4-ethylphenyl)aminophenyl]-benzene (TEPAB) was substituted for Bisflectol in the case of EXAMPLE 70 and for OXA in the case of COMPARATIVE EXAMPLE 24 and the layer thickness were 10 μm instead of 17 μm and 16 μm instead of 14 μm respectively.

The half-wave oxidation potentials versus s.c.e. of TEPAB and OXA determined as described above were 0.885 V and 0.870 V respectively, a difference of 0.015 V.

The characteristics of the thus obtained photosensitive recording materials were determined as described above. The sensitivity to monochromatic 540 nm light exposure is expressed as the % discharge at an exposure ($I_{540}t$) of 38 mJ/m² and the steepness of the discharge-exposure dependence is expressed as the % discharge observed between exposures ($I_{540}t$) of 12 mJ/m² and 38 mJ/m² a factor of 3.16 difference in exposure. The results are summarized together with those for COMPARATIVE EXAMPLE 27 in TABLE 16 below.

Figure 20:
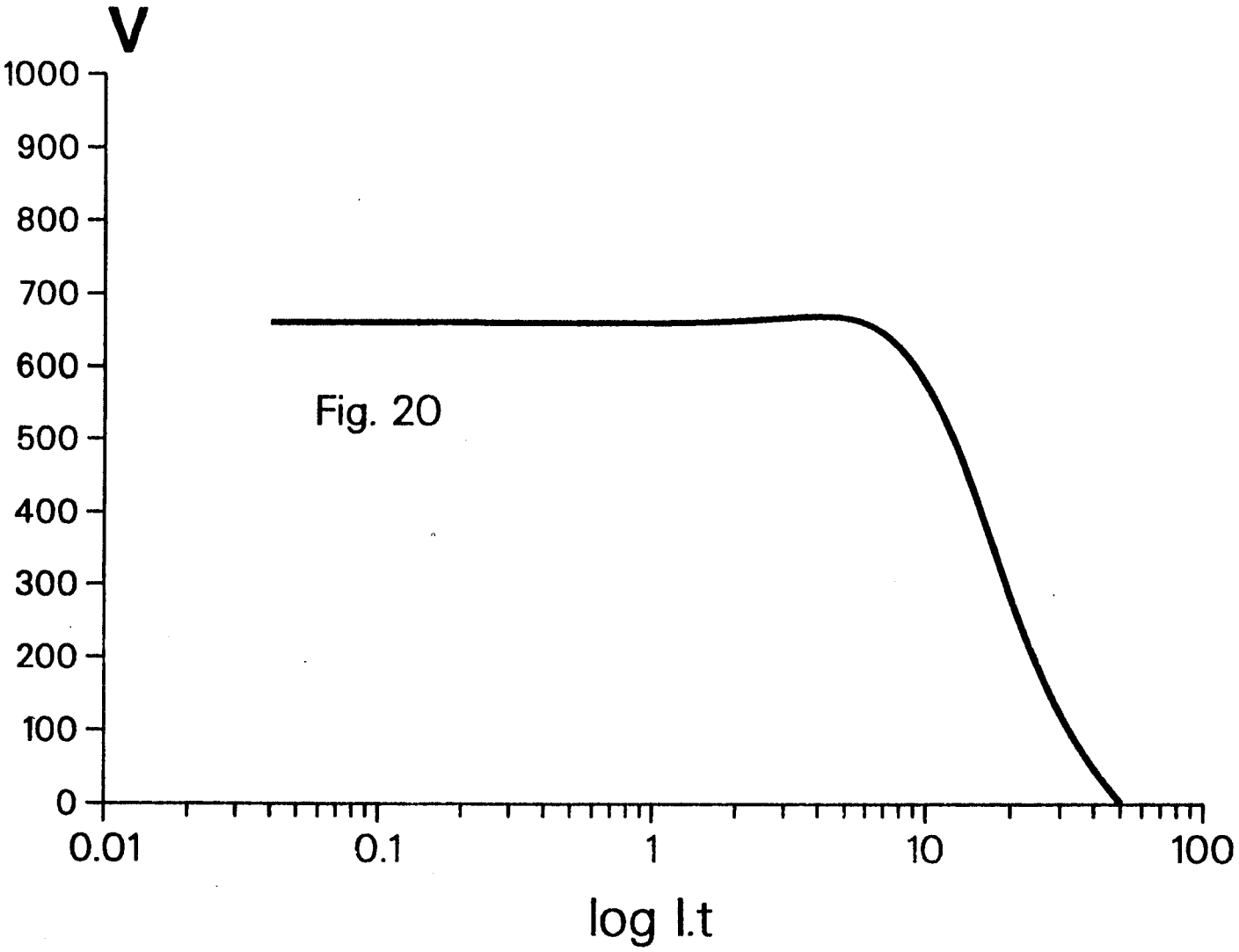
Figure 21:
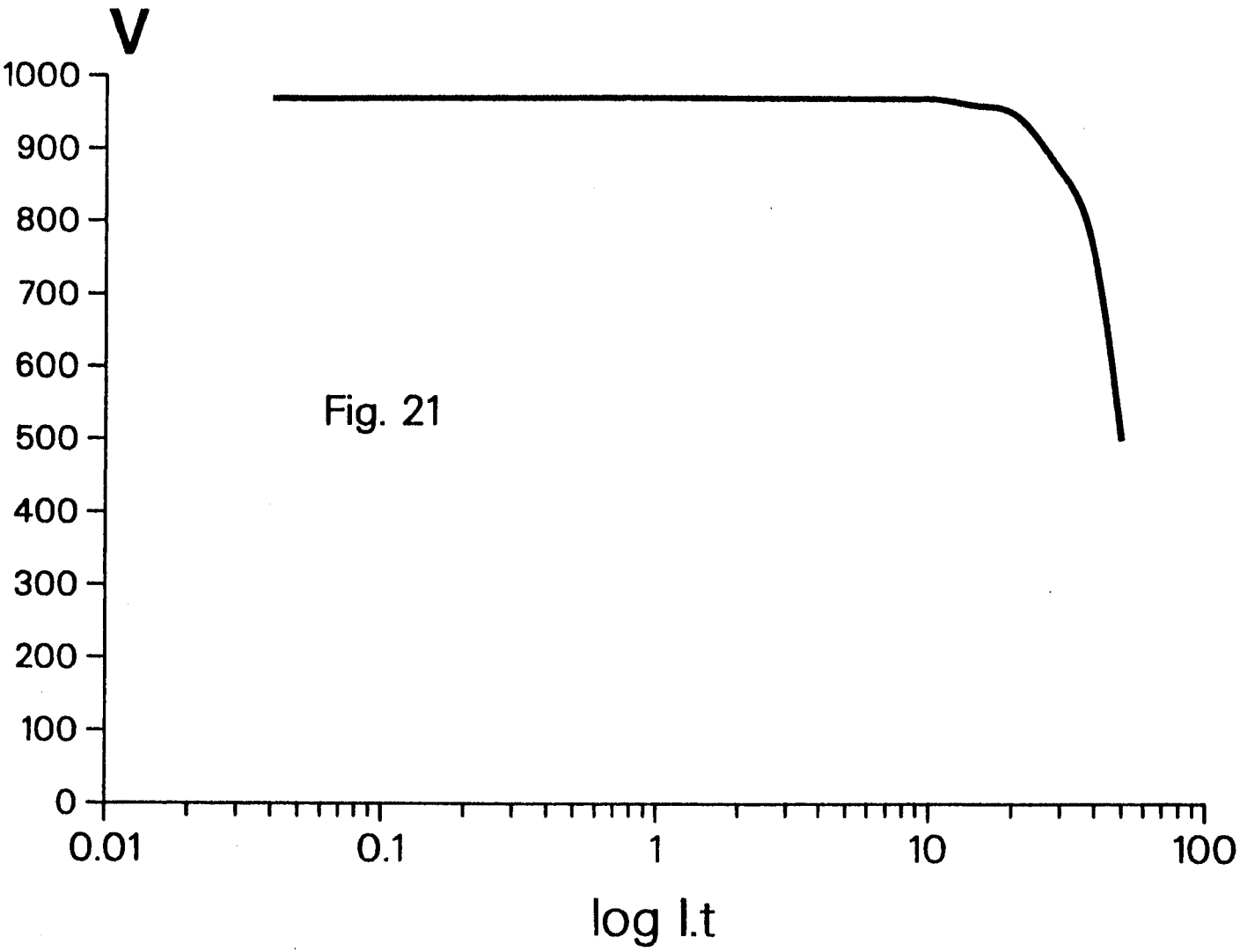

Sensitometric measurements were carried out using the refined sensitometric measurement techniques described above. The resulting sensitometric curve for the photosensitive layer of EXAMPLE 70 and COMPARATIVE EXAMPLE 24 are shown in FIGS. 20 and 21. The exposures required for 10% and 90% discharge differ by factors of 3.3 and >>1.9 for the photosensitive layers of EXAMPLE 70 and COMPARATIVE EXAMPLE 24 respectively.

TABLE 16

| | DBA conc. [wt %] | TEPAB conc. [wt %] | OXA conc. [wt %] | P1 conc. [wt %] | P2 conc. [wt %] | layer thickness [μm] | CL [V] | % discharge for $I_{540}t$ = 38 mJ/m² | % discharge between $I_{540}t$'s of 12 and 38 mJ/m² |
|---|---|---|---|---|---|---|---|---|---|
| Example No. | | | | | | | | | |
| 70 | 25 | 5 | 5 | 58.5 | 6.5 | 10 | −532 | 96.4 | 74.4 |
| COMPARATIVE EXAMPLE No. | | | | | | | | | |
| 22 | 25 | 0 | 10 | 58.5 | 6.5 | 10 | −627 | 97.0 | 68.6 |
| 24 | 25 | 10 | 0 | 58.5 | 6.5 | 16 | −749 | 18.6 | 13.4 |

EXAMPLES 71 TO 73

The photosensitive recording materials of EXAMPLES 71 to 73 were produced as described for EXAMPLE 58 except that in all cases the Bisflectol concentration has been increased and in two cases the DBA concentration was been varied with corresponding adjustments to the P1 and P2concentrations. The DBA, Bisflectol, P1 and P2 concentrations are given in Tables 17 together with the photosensitive recording material layer thicknesses.

The characteristics of the thus obtained photosensitive recording materials were determined as described above. The sensitivity to monochromatic 540 nm light exposure is expressed as the % discharge at an exposure ($I_{540}t$) of 38 mJ/m² and the steepness of the discharge-exposure dependence is expressed as the % discharge observed between exposures ($I_{540}t$) of 12 mJ/m² and 38 mJ/m² a factor of 3.16 difference in exposure. The results are summarized together with those for EXAMPLES 4, 9, 10, 15 and 19 to 21 in TABLE 17 below.

TABLE 17

| Example No. | DBA conc. [wt %] | Bis-flectol conc. [wt %] | P1 conc. [wt %] | P2 conc. [wt %] | layer thickness [μm] | CL [V] | % discharge for $I_{540}t$ = 38 mJ/m² | % discharge between $I_{540}t$'s of 12 and 38 mJ/m² |
|---|---|---|---|---|---|---|---|---|
| 4 | 30 | 30 | 36 | 4.0 | 10 | −574 | 93.0 | 56.4 |
| 71 | 25 | 21 | 48.6 | 5.4 | 13 | −692 | 85.0 | 66.9 |
| 72 | 25 | 23 | 46.8 | 5.2 | 12 | −656 | 90.9 | 69.2 |
| 9 | 25 | 25 | 45 | 5.0 | 11 | −640 | 95.8 | 70.9 |
| 10 | 25 | 30 | 40.5 | 5.6 | 8 | −524 | 96.6 | 60.9 |
| 73 | 20 | 21 | 53.1 | 5.9 | 12 | −685 | 80.0 | 61.5 |
| 15 | 20 | 30 | 45 | 5.0 | 11 | −636 | 90.3 | 63.1 |
| 20 | 16 | 24 | 54 | 6.0 | 10 | −617 | 82.2 | 54.5 |
| 19 | 15 | 20 | 58.5 | 6.5 | 11 | −697 | 66.1 | 44.6 |
| 21 | 15 | 30 | 49.5 | 5.5 | 8 | −606 | 81.2 | 48.2 |

We claim:

1. An electrophotographic recording material comprising on an electrically conductive support a negatively chargeable photoconductive recording layer which contains in an electrically insulating organic polymeric binder material at least one photoconductive n-type pigment substance and one or more p-type photoconductive charge transport substances, wherein said layer has a thickness in the range of 4 to 40 μm and comprises 8 to 80% by weight of said n-type pigment substance and 0.01 to 40% by weight of said p-type charge transport substance that is molecularly distributed in said electrically insulating organic polymeric binder material that has a volume resistivity of at least $10^{14}$ Ohm-m, and wherein said recording layer in electrostatically charged state requires for 10% and 90% discharge respectively exposures to conductivity increasing electromagnetic radiation that differ by a factor 4.5 or less, and wherein at least one p-type charge transport substance corresponds to a following general formula (I):

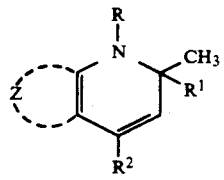

(I)

wherein:

R is a member selected from the group consisting of hydrogen, an aliphatic group, and a cycloaliphatic group including these groups substituted by non-ionic substituents, each of $R^1$ and $R^2$ (same or different) is a member selected from the group consisting of a $C_1$–$C_6$ alkyl group, and an aryl group, and Z are the atoms selected from the group consisting of those necessary to close an adjacent aromatic nucleus, and an aromatic ring system including such nucleus or ring system substituted with one or more substituents of non-ionic character; and formula (II):

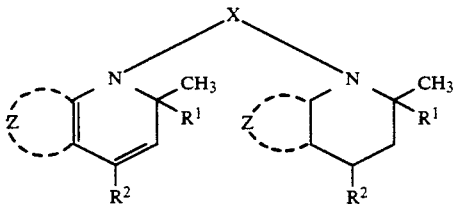

(II)

wherein:

X is a member selected from the group consisting of a bivalent aliphatic, a cycloaliphatic group, an alkylene chain interrupted by a bivalent aromatic group, and a bivalent aliphatic group wherein at least two carbon atoms are linked through a heteroatom selected from the group consisting of oxygen, sulphur and nitrogen wherein nitrogen is substituted with a monovalent hydrocarbon group, and $R^1$, $R^2$ and Z have the same significance as described for general formula (I).

2. An electrophotographic recording material according to claim 1, wherein in said recording layer a mixture is present of different p-type charge transport substances including at least one substance according to a said general formula (I) to (V), and wherein the mixed p-type transport substances have half-wave oxidation potentials that do not differ by more than 0.4 V.

3. An electrophotographic recording material according to claim 1 or 2, wherein the support of said photoconductive recording layer is pre-coated with an adhesive and/or a blocking layer.

4. An electrophotographic recording material according to claim 1, wherein the photoconductive recording layer is overcoated with an outermost protective layer.

5. An electrophotographic recording material according to claim 1, wherein said recording material has an outermost binder layer containing at least one p-type transport substance being not admixed with said photoconductive n-type pigment(s).

6. An electrophotographic recording material according to claim 5, wherein said outermost layer has a thickness not larger than 7 μm.

7. An electrophotographic recording material according to claim 1, wherein said recording layer has a thickness in the range of 5 to 35 μm and contains 10 to 70% by weight of said n-type pigment substance and 1 to 30% by weight of said p-type charge transport substance(s).

8. An electrophotographic recording material according to claim 1, wherein said recording layer has a thickness in the range of 5 to 35 μm and contains 50 to 80% by weight of said n-type pigment substance and 0.01 to 10% by weight of said p-type charge transport substance(s).

9. An electrophotographic recording material according to claim 1, wherein said recording layer has a thickness in the range of 5 to 35 μm and contains 15 to 30% by weight of said n-type pigment substance and between 20 and 30% by weight of said p-type charge transport substance(s).

10. An electrophotographic recording material according to claim 2, wherein the admixed p-type charge transport substance(s) being different from the ones represented by a said general formula (I) and (II) is a member selected from the group consisting of:

i) triphenylamines,
ii) tetra-N,N,N',N'-tetraphenylbenzidines,
iii) hydrazones,
iv) pyrazolines,
v) oxadiazoles,
vi) triarylmethanes.

11. An electrophotographic recording material according to claim 2, wherein the admixed p-type charge transport substance(s) being different from the ones represented by a said general formula (I) and II is a member selected from the group consisting of:

i) poly(vinylcarbazoles),
ii) poly(vinylpolycyclic aromatics),
iii) pyrene-formaldehyde condensation polymers,
iv) polyxylylidenes,
v) polymeric 1,2-dihydro-2,2,4-trimethylquinolines,
vi) polymeric tetraphenylbenzidines and triphenylamines.

12. An electrophotographic recording material according to claim 1 wherein the n-type pigment(s) is a member selected from the group consisting of:

a) perylimides,
b) polynuclear quinones,
c) quinacridones,
d) naphthalene 1,4,5,8-tetracarboxylic acid derived pigments including the perinones,
e) n-type indigo and thioindigo dyes,
f) perylene 3,4,9,10-tetracarboxylic acid derived pigments including condensation products with o-diamines,
g) n-type polyazo-pigments including bisazo-, trisazo- and tetrakisazo-pigments.

13. An electrophotographic recording material according to claim 1, wherein the polymeric binder is an organic resin material selected from the group consisting of a cellulose ester, acrylate and methacrylate resin, polyvinyl chloride, copolymers of vinyl chloride, copolyvinyl chloride/acetate and copolyvinylchloride/maleic anhydride, polyester resin, aromatic polycarbonate resin and polyester carbonate resin.

14. An electrophotographic recording material according to claim 1, wherein the polymeric binder is an aromatic polycarbonate having in its structure repeating units within the scope of the following general formula:

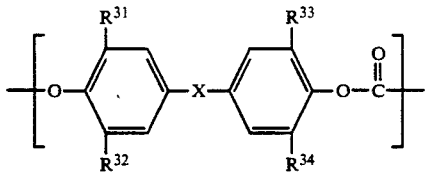

wherein:

X is a member selected from the group consisting of S,

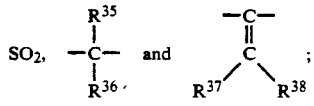

each of $R^{31}$, $R^{32}$, $R^{33}$, $R^{34}$, $R^{37}$ and $R^{38}$ (same or different) being selected from the group consisting of hydrogen, halogen, an alkyl group or an aryl group, and each of $R^{35}$ and $R^{36}$ (same or different) represents hydrogen, an alkyl group, an aryl group or together represent the necessary atoms to close a cycloaliphatic ring.

15. An electrophotographic recording material according to claim 1, wherein the polymeric binder consists of a combination of an aromatic polycarbonate and a copolyester of terephthalic acid and isophthalic acid with ethylene glycol and neopentyl glycol, the molar ratio of tere- to isophthalic acid being 3/2.

16. An electrophotographic recording material according to claim 1, wherein the n-type pigment substance is 4,10-dibromoanthanthrone.

17. An electrophotographic recording material according to claim 1, wherein the p-type charge transport substance is 1,2-bis(1,2-dihydro-2,2,4-trimethyl-quinolin-1-yl)ethane.

* * * * *